United States Patent [19]

Brown et al.

[11] Patent Number: 4,471,268

[45] Date of Patent: Sep. 11, 1984

[54] LIGHTING UNIT HAVING POWER SUPPLY WITH IMPROVED SWITCHING MEANS

[75] Inventors: Thomas A. Brown, Fulton; Marc A. Dissosway; James E. Harris, both of Liverpool; William Peil, North Syracuse, all of N.Y.

[73] Assignee: General Electric Company, Schenectady, N.Y.

[21] Appl. No.: 452,904

[22] Filed: Dec. 27, 1982

[51] Int. Cl.[3] ..... H05B 35/00

[52] U.S. Cl. ..... 315/178; 315/179; 315/207; 315/289; 315/219; 315/223

[58] Field of Search ..... 315/178, 179, 206, 207, 315/219, 223, 289

[56] References Cited

U.S. PATENT DOCUMENTS 4,320,325 3/1982 Anderson ..... 315/206

4,350,930 9/1982 Peil et al. ..... 315/178

*Primary Examiner*—Harold Dixon

*Attorney, Agent, or Firm*—John P. McMahon; Richard V. Lang; Fred Jacob

[57] ABSTRACT

An energy efficient lighting unit is described designed for functional similarity to the incandescent light used in the home. The lighting unit utilizes a metal vapor arc lamp as the main source of light supplemented by a standby filamentary light source. The lighting unit includes means for converting 60 hertz ac to dc, and a dc energized operating network containing a three transistor switch. The transistor switch is used to provide dc and low frequency (120 Hz) energization to the filament, and high frequency energization for both filament and arc lamp. The high frequency energization, which starts and transitions the arc lamp, is discontinued after the arc lamp is started. In the final run state, the arc lamp, which is serially connected with the filament across the dc supply, is ballasted by the filament. The transistor switch is controlled in its operation by an integrated circuit.

11 Claims, 14 Drawing Figures

FIG. 2

| STATE OF LIGHTING UNIT | DC FILAMENT | DUTY CYCLED FILAMENT | RF INTERROGATE | EXTENDED RF INTERROGATE | WARM UP | FINAL RUN | END OF LIFE |
|---|---|---|---|---|---|---|---|
| DURATION | 217-512 mSEC | 0-34.1 SEC | 10μ - 31 mSEC | 2+ SECONDS | 30 - 90 SECONDS | —— | —— |
| POWER INPUT | 85 WATTS | 60 WATTS | 50 WATTS | 55 - 85 WATTS | 85 - 57 WATTS | 57 WATTS | <2 WATTS |
| ARC LAMP (11) | —— | —— | 2300V PEAK AT 100 KHz | 500 - 15V PEAK MAX AT 100 KHz | 15-92 VDC | 92 VDC | 170 VDC |
| | —— | —— | SMALL DISSIPATION | 2 - 15 WATTS DISSIPATION | 10 - 32 WATTS | 32 WATTS | 0 WATTS |
| | 0 LUMENS | 0 LUMENS | NEGLIGIBLE LUMENS | LOW LUMENS | INCREASES TO FINAL LUMENS | 2300 LUMENS | 0 LUMENS |
| FILAMENTARY RESISTANCE (12) | DC WITH 120 Hz RIPPLE | 120 Hz PULSATING | 100 KHz PULSATING | 100 KHz PULSATING | DC WITH 120 Hz RIPPLE | DC WITH 120 Hz RIPPLE | POWER SWITCH OFF |
| | ~80 WATTS | ~56 WATTS | ~45 WATTS | 45 - 75 WATTS | 75 - 23 WATTS | 23 WATTS | 0 WATTS |
| | ~1400 LUMENS | ~800 LUMENS | ~600 LUMENS | 600-1200 LUMENS | ~1200 LUMENS TO MIN. | MIN. LUMENS | 0 LUMENS |
| | PREIGNITION | | IGNITION | | IGNITED | | FAILURE |

TO FIG. 5C (SH. 7)
FROM FIG. 5A (SH. 5)
FF11
FF10
FF9
FF8
FF7
MUX 1
A OR B
FF24
SR4 LATCH
NR10
FF20
MUX 2
I11
I3
I4
ND12
NR8
NR9
ND7
ND9
ND8
ND10
FF18
FF19
ND15
ND4
ENABLE
RF OSCILLATOR
OUT
PI
R OSC

FF17
FF16
FF15
FF14
FF13
FF12
NR15
I10
ND21
Q5
Q6
I9
ND22
NR13
ND20
NR12
I7
NR11
I6
ND11
Q7
Q8
ND23
NR14
I8
FILAMENT OUTPUT
P4
P3
RF OUTPUT
P7
Vdd
GND
P6
MUX 3
A OR B
SR3 LATCH
FROM FIG. 5A (SH. 5) 1
FROM FIG. 5A (SH. 5) 3
FROM FIG. 5A (SH. 5) 2
FROM FIG. 5A (SH. 5) 4
FROM FIG. 5B (SH. 6)
A
B
C
D
E
F
G

LIGHTING UNIT HAVING POWER SUPPLY WITH IMPROVED SWITCHING MEANS

RELATED PATENTS AND APPLICATIONS

U.S. Pat. of Cap and Lake, No. 4,161,272, entitled "High Pressure Metal Vapor Discharge Lamps of Improved Efficacy".

U.S. Pat. of Peil and McFadyen, No. 4,350,930, entitled "Lighting Unit".

U.S. patent application of Peil, Brown and Harris, Ser. No. 305,653, filed Sept. 25, 1981, entitled "Lighting Unit".

Application of Peil, Brown and Dissosway, Ser. No. 390,359, filed June 21, 1982, entitled "A Pulse Generator for IC Fabrication".

Application of Peil, Brown and Dissosway, Ser. No. 393,696, filed June 30, 1982, entitled "A Threshold Amplifier for IC Fabrication".

Application of Peil, Brown and Dissosway, Ser. No. 433,883, filed Oct. 13, 1982, entitled "Integrated Power on Reset (POR) Circuit for Use in an Electrical Control System"

Application of Peil, Brown, Dissosway and Vamvakas, Ser. No. 452,910, filed Dec. 27, 1982, entitled "Lighting Unit With Improved Control Sequence".

BACKGROUND OF THE INVENTION

1. Field of the Invention

The present invention deals with a lighting unit designed for functional similarity to an incandescent light source in which the principal source of light is an arc lamp supplemented by a standby filamentary light source, and which includes a compact "high frequency" power supply unit operating from a conventional 120 volt 60 hertz source.

More particularly, the present invention deals with the operating network in the power supply unit, and with the optimization of the switching means included in the operating network for both filament and arc lamp operation.

2. Description of the Prior Art

The present invention is a product of efforts to produce an energy efficient and comparatively low cost replacement unit for the electrically inefficient incandescent lamp. With the costs of energy rising, a need has arisen for a lighting unit which converts electrical energy into light with greater efficiency. Recently, as disclosed in U.S. Pat. No. 4,161,672, smaller, low wattage, metal halide lamps having high efficiencies and light outputs comparable to home incandescent lamps have been invented. Such lamps are potential energy efficient replacements for the home sized incandescent lamp provided that convenient low cost provisions can be made for standby illumination when such lamps are being started and for supplying the diverse electrical requirements for the standby and principal light sources.

The power supply of the present lighting unit represents an outgrowth of earlier high frequency power supplies in which a ferrite transformer, then controlled for non-saturated operation, and a transistor switch were significant elements. Such power supplies are disclosed in U.S. Pat. No. 4,350,930 and U.S. application Ser. No. 305,653.

In the application Ser. No. 305,653, the power supply therein disclosed produces an initial sustained (8 sec.) period of dc filament energization by means of a first, SCR switch conducting current from the dc supply, followed by a short duration period (8 msec) of high frequency operation of a second, transistor switch. High frequency operation of the second, transistor switch, which is sustained (2 sec.) after arc lamp current is sensed, ignites the arc, and provides the necessary power to transition the arc to the point where the dc supply will sustain it. Meanwhile, the high frequency switch operation also energizes the standby filament. When the arc has transitioned, and switching operation has discontinued, the filament continues to be energized by its series connection through the arc lamp to the dc supply. As the voltage of the arc increases as the arc lamp warms up, the filament dissipates less power, and in the final run condition, the filament is much less incandescent and draws relatively little power. In the foregoing arrangement, the switching means required to provide for the initial dc operation of the filament were separate from the high frequency switching means used for both filament and arc lamp energization. The timing of the switching operation and the requirement of separate semiconductor switches tended to increase the parts count and circuit costs, while the circuit did attain the desired performance objective of reduced electromagnetic interference during starting.

SUMMARY OF THE INVENTION

It is an object of the invention to provide an improved power supply for a lighting unit combining an arc lamp with a standby filamentary light source.

It is another object of the invention to provide an improved operating network for use in a power supply for said lighting unit.

It is still another object of the invention to provide an operating unit having improved switching means.

It is a further object of the invention to provide an operating network for use in a power supply having improved switching means capable of switching heavy filament currents at dc or at low switching rates and capable of switching at the higher rates required for ignition of the arc lamp.

These and other objects of the present invention are achieved in a lighting unit powered from the customary 120 V AC main by a self-contained power unit including a low voltage (Vdd) dc supply. The lighting unit includes a metal vapor arc lamp having an anode and a cathode, and an operating network including an incandescible filamentary resistance, which provides both standby light and ballasting for the arc lamp during normal operation. The operating network further comprises a transformer for deriving a stepped-up output voltage, having a first and a second winding, a capacitor, a semiconductor switch comprising a three transistor combination, each transistor having a base, emitter and collector electrode, and cascade connected in a Darlington mode, and control means for operating the switch in a multistate arc lamp starting sequence.

The arc lamp and operating network are connected in four branches diverging from a common node and leading to the dc supply terminals. The filamentary resistance is connected in a first branch between the first source output terminal and the node. The second winding and the arc lamp are connected in series in a second branch between the node and the second source terminal (Gnd). The third transistor is connected with its collector and emitter in a third branch between the node and the second source terminal. The first winding and the capacitor are serially connected in a fourth branch between the node and the second source terminal.

The three states of the starting sequence are as follows. The first is a preignition state in which the switch is operated in a dc mode or at a low switching rate for conducting current through the serially connected first and third branches. This state provided incandescent operation of the filamentary resistance, with the capacitor precluding dc current flow through the first winding or significant ac energy transfer at the low switching rate to the second winding. The second state is an ignition state in which the switch is operated cyclically at an appropriately high switching rate for energizing the first, second and fourth branches for continued incandescent operation of the filamentary resistance and for ignition and transition of the arc lamp. The third is an ignited state in which the switch remains off, with the current supplied from the dc source flowing in the serially connected first and second branches to maintain the arc, the filamentary resistance acting as a ballast to stabilize arc current.

In accordance with an aspect of the invention, the control system comprises a first base drive means coupled to the base of the first transistor in the semiconductor switch for low switching rate operation, and a second base drive means coupled to the base of the second transistor for high switching rate operation. The first base drive means provides two turn-on signals to the base of the first transistor. The first turn-on signal is dc or short duration, suitable in length and amplitude to heat a cold filament to incandescence. The power level here is 85 watts. The second turn-on signal is a signal pulsating at a low switching rate (e.g. 120 Hz), having a duty cycle selected to maintain the filament at incandescence at a lower power level (60 watts) than the first turn-on signal.

The capacitor connected in series with the first winding in the fourth branch has a value selected in respect to the parameters of the transformer and the high switching rate to provide an adequately large transformer output voltage (e.g. 2300 V) for ignition, and optimum power (2–15 watts) for transitioning the arc to the point where it will operate stably at a low voltage available from the dc supply.

In the preferred connection, the transformer windings are mutually oriented so that the voltages in the two windings add to increase the ignition voltage between the anode and cathode of the arc lamp.

The circuit will operate more efficiently when means are provided to remove stored charge from the third or output transistor. Preferred means comprise a diode poled for forward conduction inserted in the emitter path of the third transistor and a resistance connected between the base of the third transistor and the second source terminal (gnd) having a low value (e.g. 12Ω) selected to remove the stored charge for efficient operation at the selected switching rate.

When the first and second base drive means are incorporated in an integrated circuit, means are provided to protect the integrated circuit from the injection of negative polarity transients via the base drive connections, NPN transistors being assumed. For instance, the collectors of the first and second transistors may be connected together and to the cathode of a diode whose anode is connected to the collector of a third transistor preventing negative transients from being coupled from the switching circuit output to the collectors of the first and second transistors. The negative transient protection means may further include a diode connected from the emitter of the second transistor to the second source terminal poled to preclude the bases of the first and second transistors from going substantially negative.

BRIEF DESCRIPTION OF THE DRAWINGS

The novel and distinctive features of the invention are set forth in the claims appended to the present application. The invention itself, together with further objects and advantages thereof, may best be understood by reference to the following description and accompanying drawings, in which:

FIG. 2 is a table of the states of the lighting unit indicating the duration and nature of the power supplied to the arc lamp and to the standby light source through preignition, ignition and the ignited states;

FIG. 5D shows the logic of an exemplary NOR-gate SR latch; FIG. 5E shows the logic of an exemplary NAND-gate SR latch; and FIG. 5F shows the logic design of an exemplary multiplexer shown in FIGS. 5A, 5B and 5C;

FIG. 7A being appropriate for discrete fabrication and FIG. 7B being appropriate for fabrication as a single integrated unit.

DESCRIPTION OF THE PREFERRED EMBODIMENTS

Figure 1:
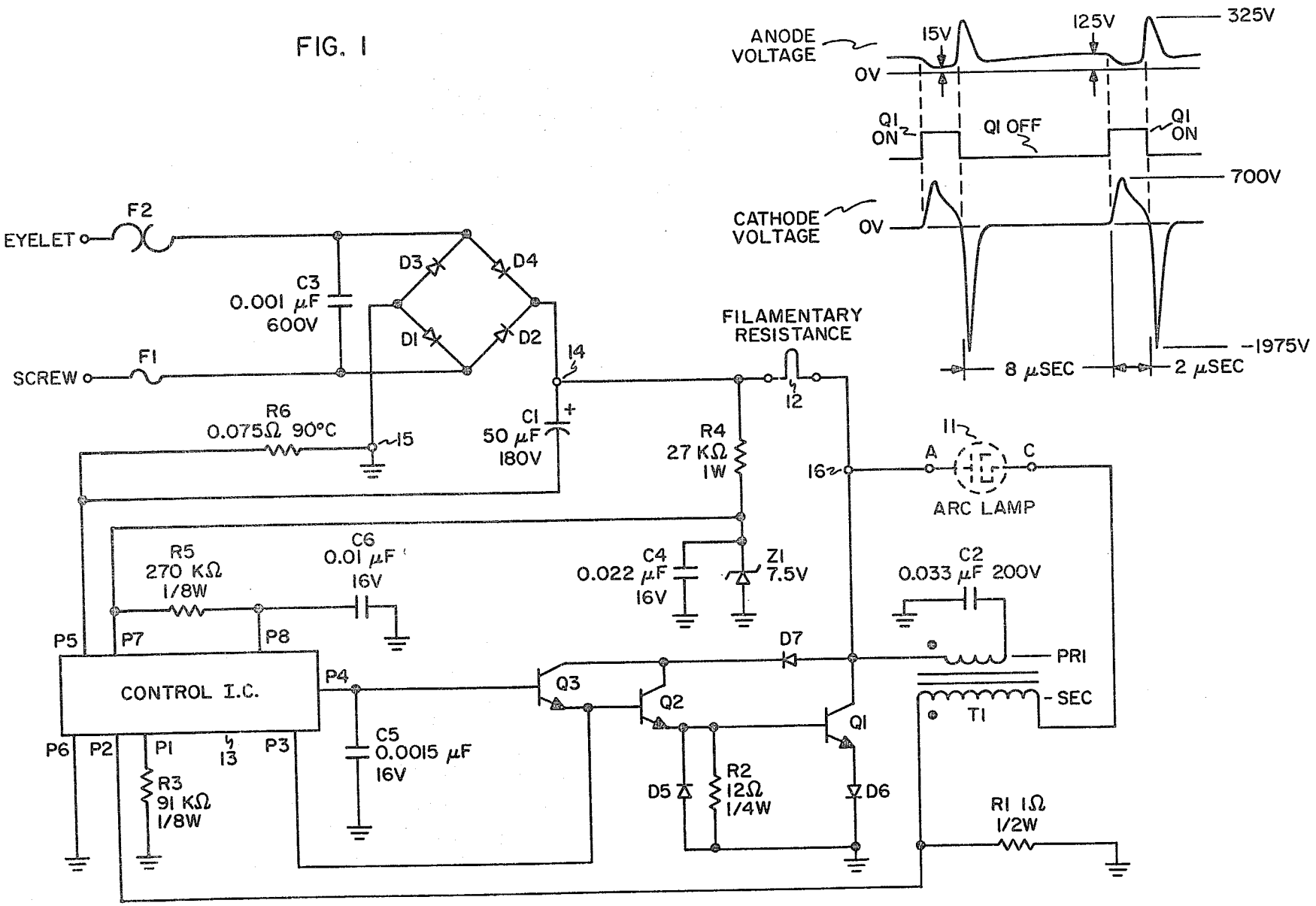
FIG. 1 is an electrical circuit diagram of a novel lighting unit suitable for connection to a standard lamp socket and including an arc lamp as a principal light source, a standby filamentary light source, and a compact integrated circuit controlled power supply unit.

Referring now to FIG. 1, the electrical circuit diagram of an efficient lighting unit for operating an arc lamp from a conventional low frequency (50–60 Hz) alternating power source is shown. The present embodiment represents an improvement over the lighting units described in U.S. Pat. No. 4,350,930 issued Sept. 11, 1982 and U.S. patent application Ser. No. 305,653 filed Sept. 25, 1981. The improvements of the present embodiment deal with modifications of the power supply to the lighting unit, including control means. The control means entail the use of a control integrated circuit designed to provide a unit which, in all lamp states, has minimum electromagnetic interference, and which has improved versatility, improved reliability, and improved user convenience.

The lighting unit comprises a lamp assembly which produces light, and a power supply unit which supplies electrical power to the lamp assembly, with certain elements of the lighting unit having dual light production and ballasting functions. The lamp assembly includes both a high efficiency arc lamp 11 and a filamentary resistance element 12 contained within a glass enclosure (not shown). The resistance element 12 is both a ballast to the arc lamp and a suplemental light source. The power supply unit includes a case (also not shown) attaching the glass enclosure to a screw-in base. The base provides electrical connection and mechanical attachment of the lighting unit to a conventional ac lamp outlet. The power supply of the lighting unit develops the required energization for the arc lamp during starting and operating conditions, and produces instant illumination by use of the supplemental filamentary light source.

The lighting unit may be switched on, restarted, or turned off with substantially the same convenience as an incandescent lamp. The delays in production of light normally attendant upon the starting of an arc lamp have been made less objectionable by the use of the light supplementing incandescible filamentary resistance 12. The filamentary resistance and the arc lamp are both packaged within the same enclosure which is of the approximate size of a conventional light bulb.

The arc lamp 11 is of the form of a small quartz vessel which is cylindrical except for a small central region of larger cross section, but not larger than ½" in diameter. The arc lamp has two electrodes, one sealed in each end. The interior of the arc lamp is formed into a spherical or elliptical central chamber filled with an ionizable mixture, including argon, an ionizable starting gas, mercury, which is vaporized when hot, and vaporizable metal salts such as sodium and scandium iodide. When operating, an arc is formed between the electrodes which creates illumination through the chamber. Small, low power lamps of the type just described are referred to as metal halide or metal vapor lamps. A suitable lamp is more fully described in U.S. Pat. No. 4,161,672 to Cap and Lake entitled "High Pressure Metal Vapor Discharge Lamps of Improved Efficiency" and assigned to the Assignee of the present application.

Light production is shared between the arc lamp 11 and the filamentary resistance 12, with the latter also providing resistive ballasting for the arc lamp. In normal "final run" operation, the filamentary resistance 12 conducts the current flowing in the arc lamp but primary light generation occurs in the arc lamp.

In starting or restarting the arc lamp (i.e. ignition), the filamentary resistance (12) produces supplemental illumination.

The arc lamp exhibits several distinct states in conventional use and each active state requires a distinctive energization from the power supply input. From a practical viewpoint, the arc lamp has three essentially active states denominated Phases I–III and an inactive state. The power unit may be regarded as having a total of 7 operating modes required by specific lamp states including preignition (filamentary preheating and standby light), ignition (high frequency interrogation of the arc lamp), ignited (low voltage dc operation of the arc lamp) and failure (end of life mode when the arc becomes inoperative) as described in FIG. 2.

In the preignition state, only the filament is energized, taking one of two modes: dc (85 watts input power) and 120 hertz pulsating dc (60 watts input power).

In the ignition state, lamp excitation may take two modes: one is a pulse train (typically 2300 V peak, 100 kHz) of short duration, the other is also a pulse train (typically 15–500 V peak, 100 kHz) of longer duration once arc current is sensed. The duration of the initial interrogate pulse trains supplied by the power supply unit before breakdown is between 10 microseconds and 31 milliseconds. The RF interrogate pulses are at a suitably high voltage (typically 2300 V peak) to cause electrical breakdown of the gas contained in the arc lamp (Phase I) initiating a falling maximum lamp voltage. This latter condition is also referred to as the establishment of a "glow discharge".

When ignition of the arc lamp begins, as a result of the initial RF interrogate pulses, a sudden drop from the 2300 volt ignition voltage to a range between 15 and 500 volts occurs. Frequently, the lamp may re-fire a second time, generally from a lesser maximum voltage as the ionization level of the contained gases increases. For breakdown, arc lamps of the design herein contemplated require between 1000 and 2000 volts using pulses of microsecond duration during the 10 microsecond to 31 millisecond interrogate interval.

If conduction is sensed in the arc lamp, an approximately 2 second Extended Interrogate energization is provided by the power supply unit to achieve the glow to arc transition of the arc lamp (Phase II). The transition state is characterized by a more sustained ionization level and a lower maximum voltage. As it begins, the discharge is typically unstable, swinging between a maximum and a minimum value, with the voltage of the discharge falling continually from decreasing maximum levels to a recurring minimum level near 15 volts. As gas conduction increases, the maximum lamp voltage falls, the consumed power increases, and the temperature inside the lamp also increases. As the maximum arc voltage falls through values near 500–150 volts, greater energy (typically 2–15 watts) is required of the power supply unit to sustain the arc in a metal vapor lamp as herein disclosed.

The transition is complete with the establishment of a stable low voltage arc, which occurs when a portion of the cathode has reached thermionic emission temperatures, also referred to as Phase III operation. The Extended Interrogate energization is of fixed length, and is designed so that under normal conditions, the arc lamp will usually attain thermionic emission (Phase III). At the (usually) marked transition to Phase III, the voltage of the discharge loses its unstable quality and holds to an initial value of about 15 volts. In this mode, designated the ignited state in FIG. 2, the arc is sustained without further RF excitation. The control means (as will be explained) require that the RF excitation terminate 2 or 3 milliseconds prior to checking for the presence of arc current, which would indicate that the lamp has transitioned to Phase III. In Phase III, a sustained low lamp impedance is exhibited, requiring a current limiting ballast to prevent excessive heating and destruction.

The initial period of ignited operation is the warm-up period, which normally lasts from 30–90 seconds. During the warm-up and final run states of the arc lamp, the power supply unit has discontinued the application of high frequency (100 kHz) energy to start the arc. At warm-up, the power supply unit has in a sense reached its final state with dc being provided to the filamentary resistance 12 and arc lamp 11 in series. However, since the arc lamp voltage is increasing, the power dissipation in the filament is decreasing and the total power provided by the power supply unit continues to decrease until it stabilizes at the Final Run value. During the warm-up period, the arc lamp reaches full operating temperature and the contained gases reach their high final operating pressures. The voltage across the arc lamp increases to a value of typically 92 volts as a result of reduction in arc lamp conductance. When the final run condition occurs, the arc lamp absorbs maximum power (typically 32 watts) and the maximum light output is produced.

The combined preignition and ignition periods provided by the power supply unit have a variable total duration programmed into the control logic having a minimum value of 2.6 seconds at normal ambient conditions and a maximum value of approximately 13 minutes counted in 34.1 sec. intervals. The longer starting durations occur when there has been an interruption of the arc and a hot restart is required. The thermal time constants of the lamp set the time required by the lamp for a hot restart at usually less than two minutes. If the lamp does not reach the ignited state in the maximum period (approximately 13 min.), the power supply goes to an inactive "End of Life" state, where minimum power is dissipated and no further attempts are made to start the arc lamp. The power supply then remains in the "End of Life" state unless the user turns off the power, and turns it back on again.

Supplemental illumination is particularly important to the user during warm-up and during hot restarting. It is provided throughout both the normal starting procedure and hot restarting. During warm-up, the supplemental illumination gradually diminishes in conjunction with the increasing light output of the arc lamp. In the final run condition, little supplemental illumination is provided.

Figure 3:
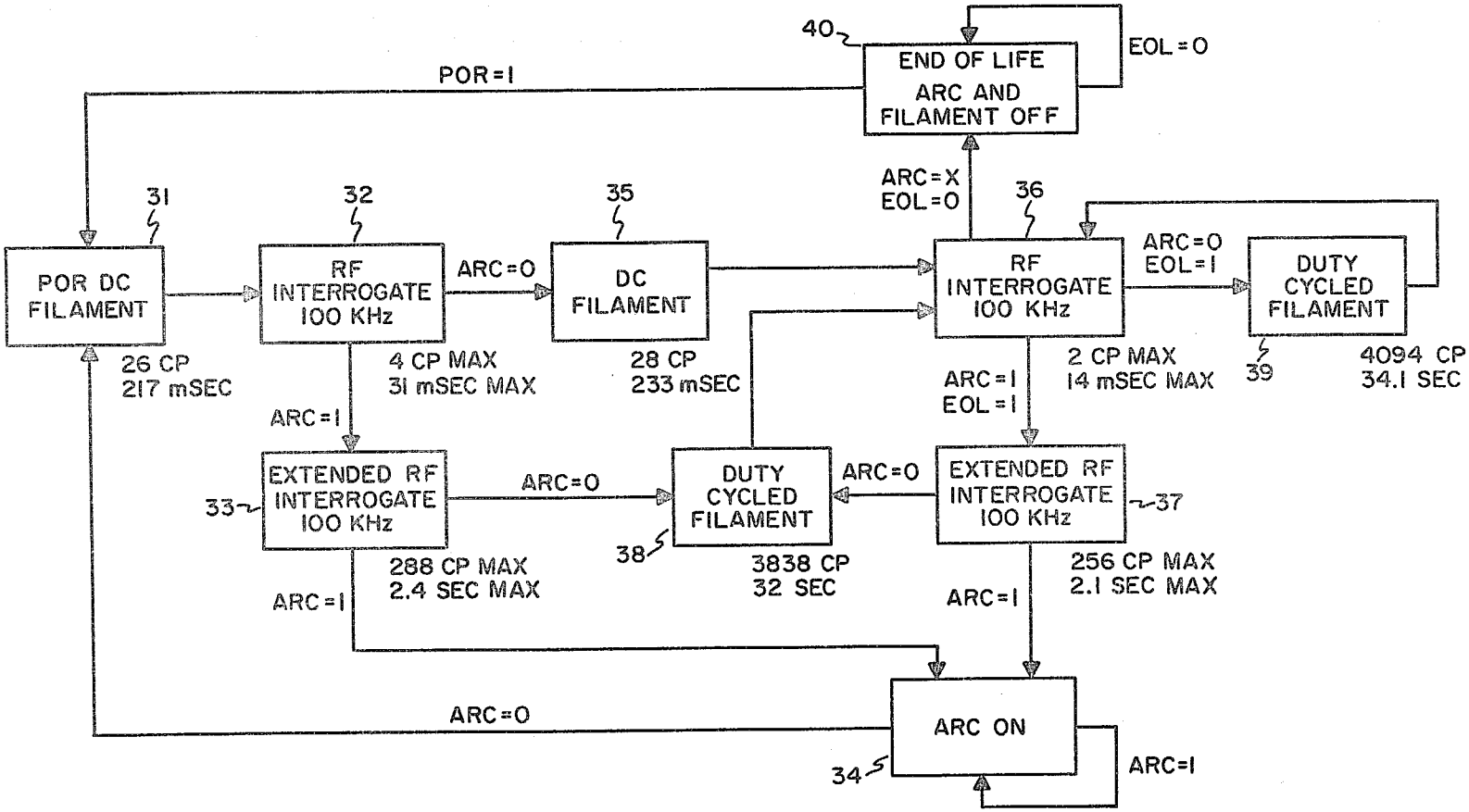
FIG. 3 is a state sequence diagram illustrating the allowed sequences of the states of the lighting unit depending on conditions.

Suitable operating power for the arc lamp and the standby filamentary light source is provided by the power supply unit illustrated in FIG. 1. The forms and duration of the power supplied to the filament and the arc lamp, at different "states" of the lighting unit are listed in the table provided in FIG. 2. The sequence in which the various forms of power are applied is indicated in FIG. 3, which shows the allowed sequences of the states of the lighting unit. The control sequences are under the control of an integrated circuit 13. The block diagram of the control IC is provided in FIG. 4 and the logic design is provided in FIGS. 5A to 5E.

The lighting unit whose electrical circuit diagram is illustrated in FIG. 1 has at its principal components the arc lamp 11, a dc power supply ($D_1$–$D_4$, $C_1$, $C_3$) for converting the 120 volt 60 Hz to dc, an operating network ($Q_1$, $Q_2$, $Q_3$, $T_1$, $R_2$, $C_2$, $C_5$, $D_5$, $D_6$, $D_7$) for converting electrical energy supplied by the dc power supply into the forms required for operation of the lamp assembly, a filamentary resistance (12) which performs a ballasting function in the operating network and provides standby light, a ballast control IC 13 for controlling the form of power supplied in a programmed sequence, and a low voltage dc (Vdd) supply for the IC ($R_4$, $C_4$, $Z_1$). Remaining components $R_1$, $R_3$, $R_5$, $R_6$ and $C_6$ are adjuncts of the IC 13.

The dc power supply circuit of the lighting unit is conventional. Energy is supplied from a 120 volt 60 hertz ac source via the fuses F1 (a current sensing fuse) and F2 (a thermal fuse) to the ac input terminals of a full wave rectifier bridge (D1–D4). The positive output terminal of the bridge is the positive output terminal 14 of the main dc (145 V) supply and the negative terminal 15 of the bridge is the common output terminal (ground) of the supply. The filter capacitor C1 is connected via R6 across the output terminals (14, 15) of the dc supply to reduce ac ripple. The output of the dc supply during normal run operation of the arc lamp is 145 volts at about 0.35 amperes current, producing an output power of approximately 57 watts, of which 32 watts is expended in the lamp and 23 watts is expended in the filamentary resistance (12) and the remainder in other portions of the unit. The power required of the dc supply by the lighting unit is momentarily higher (80 watts) during preignition. A similar power level (up to 75 watts) is required at the transition from GAT to warm-up.

The operating network, which derives its power from the dc supply, and in turn supplies energy to the lamp assembly, comprises the elements (Q1, Q2, Q3, T1, R2, C2, C5, D5, D6, D7) as earlier noted. The filamentary resistance 12 is connected between the positive terminal 14 of the dc supply and node 16. The anode of arc lamp 11 is connected to node 16, and the cathode is connected to the undotted terminal of the secondary winding of transformer T1. The dotted terminal of the secondary winding of transformer T1 is connected to ground via the 1 ohm resistance R1 and to pad P2 of IC 13. The secondary of T1 has a small dc resistance (2 or 3 ohms). The elements just recited complete a dc path for load current from the positive to the negative terminal of the 145 V dc supply. In Final Run operation, the filamentary resistance 12 provides a serial resistance for ballasting the arc lamp 11. The arc lamp current also flows through resistance R1 providing the control IC with a voltage indicative of arc lamp current.

The transistors Q1, Q2 and Q3 form a three transistor switch connected in the path between node 16 and the negative terminal 15 of the dc supply. These transistors are connected in a Darlington type configuration in which the input transistor Q3 has its base connected to pad P4 of the IC which provides control signals for filament operation in either the dc or 120 hertz ac modes.

The emitter of Q3 is connected to the base of Q2, the second transistor in the combination, and the emitter of Q2 is connected to the base of Q1, the output transistor. The collectors of Q3 and Q2 are connected via diode D7 (normally forward biased) to the collector of Q1, which is coupled to the node 16. The base of Q2 is connected to pad P3 on the integrated circuit which supplies a high frequency signal (100 kHz) for operation of the switch in the interrogate modes. Resistance R2 and diode D5 are connected in parallel from the base of Q1 to ground. Diode D5 is poled with its anode to ground. The emitter of output transistor Q1 is connected to ground via forward poled diode D6.

The operating network is completed by transformer T1, whose secondary winding connections have already been described. The dotted terminal of the primary winding is coupled to the node 16, and the undotted terminal is coupled via capacitor C2 to the ground terminal of the unit.

In the preignition state, dc filament energization is the initial mode of the lighting unit as shown in the table of FIG. 2. As the drawing of FIG. 1 illustrates, when Q1 is conductive, a dc path is closed from the positive terminal 14 of the 145 volt dc supply, via the filamentary resistance 12, transistor Q1, diode D6 to the common terminal 15 of the dc supply. The control signal for dc operation of the filament (at 80 watts) for the 0.217 second intervals required to preheat the filament to near normal operating temperature and resistance is available from the integrated circuit at pad P4. This control signal thus drives the three transistor switch permitting the filament to be energized with the desired power level during this mode.

In a second preignition mode, required primarily for hot restarting, duty cycled operation of the filament at 120 Hz is provided. The control signal is also provided to the switch from pad P4 of the control IC. In this mode, the duty cycle is selected to provide a desired level (e.g. 56 watts) of power to the filamentary resistance 12. Adjustment of amount of power delivered to the filament is achieved by selecting the time constant of resistance R5 and capacitance C6 connected to the IC at pad P8.

During the preignition period, both modes of filamentary excitation are designed to excite only the filamentary resistance with no effect on the arc lamp. Since the inductance of the primary winding and the small capacitance (0.033 μfd) C2 are designed to resonate at approximately 90 KHz, there is no effective excitation of the arc lamp in this state.

In the ignition state, which follows Preignition, the lighting unit operates in either of two modes to provide bursts of 100 KHz pulses as RF excitation for both the arc lamp 11 and the filamentary resistance 12. In the Interrogate mode these bursts are of relatively shorter duration (31 milliseconds or less) than in the Extended Interrogate mode (2.4 sec. or less). As seen in the state diagram of FIG. 3, after momentary dc filament energization, the control IC generates an interrogate signal of about 31 milliseconds duration. If R1 in the arc lamp circuit senses arc current, an input coupled to pad P2 of IC 13 initiates the Extended Interrogate mode. For this mode, the 100 kHz RF excitation occurs without interruption for at least 2.1 seconds which normally allows complete transition of the arc to warmup (Phase III). The dc supply for application of continuous power to the arc lamp through the filamentary resistance is present at all times, so that, in the typical case where arc lamp transition is completed during Extended Interrogate, adequate dc energy is available to sustain the arc. At the end of the extended interrogate, the IC provides a 2 to 3 millisecond pause in RF excitation. During this interval cessation of the arc will cause a repetition of the RF interrogate procedure. However, if continuous arc current is sensed by the IC at pad P2, the IC will allow normal transition into the ignited state (no further interrogation). The state diagram of FIG. 3 includes the normal starting sequences as well as other eventualities in the starting procedure, which will be described after a more detailed treatment of the interrogate and extended interrogate states.

High frequency energy (100 kHz) for the Interrogate and Extended Interrogate states is provided at the output of the step-up transformer T1 by the high frequency switching of transistors Q1 and Q2 under the control of the IC.

At the end of the time allocated to preignition, the IC signal at pad P4 switches from an on to an off level for driving the base of Q3. At the same time, a high frequency signal from output pad P3, consisting of 100 kHz bursts, is applied to the base of Q2. The frequency of this signal is established by an oscillator contained on the IC, whose frequency is set by the value of the resistance R3 connected to pad P1. The IC also contains means for gating the oscillator signal to a large buffer capable of providing suitable current for switching Q2 and Q1 at the desired high frequency rate.

Switching of transistors Q1 and Q2 in high frequency bursts produces the 2300 volt output pulses needed to start the arc and the power (up to about 15 watts) for transitioning the arc through the lower voltage states (<500 V) to Phase III, while providing sufficient standby light. Transistor Q2 is driven by the IC at the 100 kHz rate and the output transistor Q1 is in turn driven by Q2. The collector of Q1 is connected via the filament 12 to the positive terminal of the 145 volt dc supply and its emitter is connected via D6 to ground to provide an alternately conductive and nonconductive path for switching filament current at the 100 kHz rate. At the same time, Q1 also switches current in the primary winding of transformer T1 and the series capacitor C2. The value of the capacitor C2 is selected to provide maximum power to the arc lamp in the glow to arc transition region. The natural resonant frequency of capacitor C2 and the inductance of the transformer is typically about 90 kHz (the resonant frequency may be somewhat below the operating frequency of 100 kHz).

During high frequency switching, the total 2300 volt pulse excitation applied to the arc lamp is the sum of two pulses: a positive voltage pulse from the primary winding, which is applied to the anode of the arc lamp, and a negative voltage pulse from the secondary winding, which is applied to the cathode of the arc lamp. The transformer has a secondary to primary turns ratio of approximately 7 to 1. The output voltages available from the two windings add, due to the senses of the windings and the resultant waveform reaches its 2300 volt peak just after Q1 becomes nonconductive. During its conduction interval, Q1 maintains the arc lamp anode voltage at a level of approximately +15 volts. However, after Q1 turns off, the anode voltage rises rapidly to a peak of +325 volts due to the flyback effect of the transformer primary circuit. Simultaneously, the induced voltage in the secondary winding causes the cathode of the arc lamp to reach a negative peak voltage (−1975 volts). Thus, approximately 2300 volts of total excitation is available to break down the arc (start the arc lamp) at the flyback peak. The duration of the interrogate pulse is selected in respect to the starting requirements of the arc lamp so that when the arc lamp is at normal ambient temperature, starting will usually occur on the first attempt and almost always by the second attempt. (If hot restart is involved, then the starting procedure will be prolonged.)

The transformer T1 is of an economical miniature design using a cylindrical ferrite slug ½" in diameter by ¾"–1" in length, using a Stackpole 24B material (or the equivalent suitable for 100 kHz operation). The windings are wound on a spool slipped over the slug, with the 58 turn primary being wound first as a single layer winding. The 406 turn secondary winding is wound over the primary with the high voltage turns outermost. The end of the innermost turns of the secondary winding is connected via resistance R1 to ground as shown in FIG. 1. By this construction, the low voltage turns of the secondary winding which are in closer proximity to the primary winding are relatively closer to ground potential than the outer layers of the transformer in which the high voltage appears. The result of this mode of winding is to provide a Faraday shielding effect to protect the IC from higher voltage strikes appearing in the secondary winding which otherwise might be capacitively coupled into the primary winding and backward through the transistors Q1, Q2, Q3 into the IC.

During the preignition and two interrogate modes, the Q1, Q2, Q3 triple transistor switching circuit is required to conduct ampere level currents. The dc filament energization during the initial instants (100 microseconds) of preignition may be as high as 8 amperes, but stabilizes at less than an ampere to correspond to 80 watts of filament power long before the end of the 0.217 second period. During duty cycled operation the filament is operated at a 120 Hz repetition rate to produce an average filament power of 56 watts with lower average currents in the switching circuit. During Interrogate, the 100 kHz waveform requires switching of peak currents of approximately 2.5 amperes to achieve the 2300 volt peak output. During this interval the filament is dissipating significant power (45 watts). During Extended Interrogate, the dissipation in the arc lamp is from 2–15 watts, leading to a total power input of approximately 85 watts. During Extended Interrogate, average current levels in Q1 are in the one ampere range.

In the two preignition and the two interrogate modes of operation, adequate current gains are required of Q1, Q2 and Q3 to meet the load current requirements. Typically, the output transistor Q1 may have a 1 ampere beta of 3 and a 3 ampere beta of 15. A suitable transistor is a GE Type D44. Q2 and Q3 have lesser current handling capabilities and preferably higher betas (>50). A suitable device is the Motorola MPS A44. During interrogate, the peak output current of Q2 is approximately $\frac{1}{4}$ ampere of which approximately 100 milliamperes is required for the base drive for Q1, and approximately 120 milliamperes of additional current is required for the Q1 input circuit, as will be explained. For turn on, transistor Q2 requires about 10 milliamperes (typically 5 to 13 ma) of base drive from the IC pad P3, and at least 13 milliamperes of current sinking capacity to turn Q2 off.

For the preignition states, transistor Q3 provides an additional stage of high gain amplification and thus requires less drive from the IC than Q2 in the interrogate states. During 80 watt dc filament energization, the current required at IC pad P4 to drive Q3 is from 1 to 2.6 milliamperes, and the sinking current capacity should exceed one milliampere to prevent Q3 from turning on in the ignition state. In duty cycled filament operation (56 watts), the current required to turn Q1, Q2, Q3 on is from $\frac{1}{3}$ to $\frac{2}{3}$ milliamperes and the required current sinking capacity is from $\frac{1}{3}$ to $1\frac{1}{2}$ milliamperes.

The Q1, Q2, Q3 switching circuit is optimized for maximum switching efficiency and transistor reliability at the operating frequency and voltage. The transistors are high voltage devices having 400 to 500 volt ratings and all are required to have a fast turn off capability. the output voltage being proportional to the induced voltage in the transformer primary $$\left(L\frac{di}{dt}\right).$$

Typical low cost power transistors without special turn off measures, retain a stored change for too long to permit attaining the di/dt required to develop a 2300 volt output peak when $2\frac{1}{2}$ amperes of current flow is interrupted. Increased dissipation in the junction due to significant current flow after voltage reversal is also a concern when ampere level currents are switched at 100 kHz rates. To avoid these problems, diode D6 in the emitter path of Q1 and resistor R2 (12 ohms) connected between the base of Q1 and ground have been added. These assist in clearing stored charge from Q1 at the end of each switching interval, thus steepening the turn-off transient, and reducing dissipation in the device. Diode D6 (1N 4001) is chosen to have a stored charge greater than that of Q1. When the forward drive applied to the base of transistor Q1 is terminated to turn it off, the forward biased junction of D6, momentarily supported by its stored charge, and the forward bias of the input junction of Q1, also momentarily supported by its own stored charge, add to form a $1\frac{1}{2}$ volt generator shunted by a 12 ohm resistance. During high frequency operation, diode D6 with its stored charge thus acts as a battery to support the removal of stored charge through R2 at about a 120 milliampere rate. The combination removes the charge stored in Q1 sufficiently quickly to permit switching at the 100 kHz rate, and with the steep turn-off characteristic required to attain the 2300 volt peak output.

The Q1 input circuit (D6, R2) increases the current drive required from Q2 and in turn that required from the output pad P3. The emitter diode D6 raises the voltage drive level at the base of Q2 to about 2.6 volts (3 diode drops) and the additional current (approximately 120 ma) drawn by R2 (12 ohms) at the 2 diode drop voltage, is reflected in the Q2 base current values noted above. The speed enhancement provided by this circuit is more cost efficient than alternative techniques.

The timely removal of stored charge on the input junction of Q2 must also be considered for efficient switching at the 100 kHz switching rate. This is achieved in the present configuration by providing a 13 milliampere current sinking capability at pad P3 on the IC.

Finally, means must be provided to preclude negative transients generated by the high frequency, high voltage switching from entering the integrated circuit at pad P4 or P3. In addition to the shielding provided by the winding configuration of T1, the diode D7 is inserted in the path between the collectors of Q1 and Q2 to block the application of negative going transients to the collectors of Q2 and Q3.

Another potential path by which indesirable negative going transients from the output circuitry could reach the integrated circuit is via the base emitter junctions of Q2 or Q3, if either of these junctions becomes forward biased. Diode D5 minimizes this possibility by effectively precluding the emitter of Q2 from being driven more than one diode drop below ground. Even if the input junction of Q2 is forward biased, the diode clamp D5, on the emitter of Q2, prevents the base of Q2 and pad P3 from going negative. Additionally, if the input junction of Q3 becomes forward biased, the Q3 base voltage is one diode drop above ground, thus the IC is also protected at pad P4. The capacitor C5 at the base of Q3, which reduces emi by slowing the rise time in 120 Hz Filament operation, also provides additional transient immunity at pad P4.

The successful transitioning of the arc lamp to Phase III initiates the two "ignited" states of the table of FIG. 2. In these two states, the transistor switch Q1, Q2, Q3 is off, and the 145 $V_{dc}$ supply (D1–D4, C1), maintains the arc, supplying current to the filamentary resistance and the arc lamp connected in series across the dc supply. The power levels for warm up and final run operation are shown in the last two columns in FIG. 2. The power consumed in the arc lamp increases from an early warmup value of 10 watts to a final run value of 32 watts and the power consumed in the filamentary resistance decreases from an early warmup value near 75 watts to a final run value of 23 watts.

The foregoing review of the six states of the lighting unit has taken an ordered, minimum duration progression from preignition to the final run state. Because of variations in ambient conditions of the arc lamp, the hot restart condition, the eventual failure of the arc lamp due to aging, and a continuing effort to minimize radio frequency interference, when starting is attempted, a control IC 13 has been provided. It is designed to control the lighting unit in its assumption of successive operating states.

The chart in FIG. 3 illustrates the states of the lighting unit, their duration, and the basis by which successive states are entered. When the lighting unit is first energized, a Power On Reset condition is instituted, which presets the control logic of the IC to a desired initial or "reset" state prior to the initiation of the clock pulse "count". The states, whose existence and duration depend upon the clock pulse count, then proceed in accordance with the count, and sensed arc lamp current. The clock pulse interval is based on the ac line frequency coupled to the IC at pad P5, by which charging current pulses flowing through the series circuit including the 0.075Ω resistance R6 and the filter capacitor C1 are sensed. The clock pulse interval is approximately $8\frac{1}{3}$ milliseconds. The state sequence diagram of FIG. 3 shows the duration of each state in milliseconds and in clock pulse counts.

The state sequence diagram of FIG. 3 commences at an initial state 31, entitled "POR-DC Filament", which is the first state in the table of FIG. 2 under "Preignition". When the starting procedure is over, with the arc lamp on, the state 34 entitled ARC ON will have been achieved, corresponding to Final Run in FIG. 2. If the arc lamp does not come on in the course of the procedure, an End of Life state 40 will have been achieved with no further energy being supplied to the arc lamp or the filament.

In the initial state 31, the counter on the IC is preset to a desired initial condition by the occurrence of a preset pulse of controlled duration. When the preset pulse terminates, the counter is allowed to run and the starting procedure is initiated. (This will be referred to as Power On Reset.) Once allowed to start, the counter continues for 26 clock pulses (217 msec), during which 80 watts of dc energization is being applied to the filament. At the end of this interval, the RF interrogate state (32) is initiated. During this state, the arc condition is sensed via pad P2 of the IC connected to the 1Ω Resistor R1 in series with the arc lamp. If arc current is sensed at some point in state 32, entry into state 33(Extended RF Interrogate) occurs. State 33 continues for a prescribed 288 clock pulses (2.4 seconds). This time is selected to transition the arc lamp to the ignited state in the usual case. At the end of the 2+ second period, a two millisecond pause occurs in RF interrogation. If continuing arc current is sensed denoting that the 145 V dc supply will now sustain the arc, switch Q1, Q2, Q3 is turned off, and the ARC ON state (34) of FIG. 3 is entered. State 34 of FIG. 3 corresponds to the Warm-up and Final Run states in FIG. 2. The path "arc=1" denotes that arc on state 34 is a final state, not terminated except by operator intervention. In the event of a line transient, however, causing the arc lamp to go out, the power supply reverts to the initial state 31 (with the counter being preset, and the dc filament being momentarily energized. The presence (or absence) of the arc is sensed at pad P2 of the control IC and arc failure causes the return to state 31.

If, however, when RF Interrogate 32 is concluded, with no arc current having been sensed, then the dc filament energization is reinstituted (state 35) for 28 clock pulses (233 msec). At the end of dc filament state 35, an RF Interrogate state 36 is instituted. Assuming arc current is sensed at pad P2 before the end of the state 36, an Extended (2.1 sec) Interrogate state 37 is initiated at the time of arc current sensing. At the end of state 37, the burst is terminated for 2 msec, and if arc current continues upon termination of RF interrogation, the arc lamp is presumed to have entered Arc On (state 34).

If, after the end of either RF extended interrogate state 33 or 37, sustained arc current is not sensed, but had been sensed during the prior state (32 or 36), the logic treats the condition as corresponding to a hot restart in which a longer starting interval is required. The normal hot restart sequence goes from 36 to 39, with repeats until arc current is sensed. Arc failure after 33 or 37 leads to a duty cycled filament state 38 to 32 seconds duration in which the switch Q1, Q2, Q3 is turned on and off at a 120 Hz rate with an approximately 75% duty cycle adjusted to provide approximately 56 watts of filament dissipation. This continues for a clock count of 3838 (32 sec) followed by re-entry into the RF Interrogate state 36. The state 36 continues for 14 msec. and assuming that arc current has been sensed, proceeds to state 37 and normally to the Arc On state (34). (In the usual case, the 36, 37, 38 sequence is usually not traversed again.)

The normal hot restart sequence is 31, 32, 35, 36, 39 followed by repeats of 36, 39 until arc current is sensed and the sequence terminates with 36, 37, 34. At the end of the Interrogate state 36, a double condition must be satisfied to enter into the Duty Cycled Filament stage 39 or the Extended RF Interrogate state 37. The first condition is that arc current be sensed or not sensed and the second condition is that the end of the life counter must still be in a high state, i.e., not yet at the EOL count. In the event that arc current has not been sensed in any state prior to RF Interrogate stage 36, and the "end of life counter" (not yet described) is still in a high state, then the duty cycled filament state 39 is entered into. State 39 has a duration of 34.1 seconds (4094 clock pulses), and is the usual longer duration filament on state in a hot restart sequence.

Entry into state 39, which involves a 30+ second filament on time is not entered in a normal start. In a hot restart, there may be several entries into 39, with hot restart normally occurring within 2 or 3 minutes. If the arc fails to light in a period longer than 2 or 3 minutes, then the issue is raised whether the failure is due to hot restart conditions or to a failure of the arc lamp itself. An end of life counter is provided on the integrated circuit to insure that the attempts to start the lamp are terminated after some reasonable period greater than that required for a hot restart. In the present case, the EOL period is 94266 counts corresponding to 13.09 minutes. At the end of each state 39, and assuming that the arc does not light in interrogate state 36, the sequence involving 39-36 is repeated until the end of life counter has reached a count corresponding to 13.09 minutes. When this occurs on return to state 36, irrespective of the state of the arc, the end of life counter reaches a zero state, and forces the lighting unit into the End of Life state 40.

In the End of Life state 40, both outputs of pads P3 and P4 on the integrated circuit are low precluding further activity by the switch Q1, Q2, Q3 and leaving it in the off state. With Q1, Q2, Q3 off, the filament 12 is no longer energized and since a moment earlier no arc current was sensed, the arc lamp circuit will also be off. The dc supply D1–D4, C1, etc. remains energized but neither of its loads, lamp elements 11 or 12 draw power. In the event that the power to the lighting unit is turned off, as indicated by the path POR-1, the power on reset re-establishes the initial condition and if the operator desires, he may turn the lighting unit on again to see if the end of life did in fact signify arc lamp failure.

Figure 4:
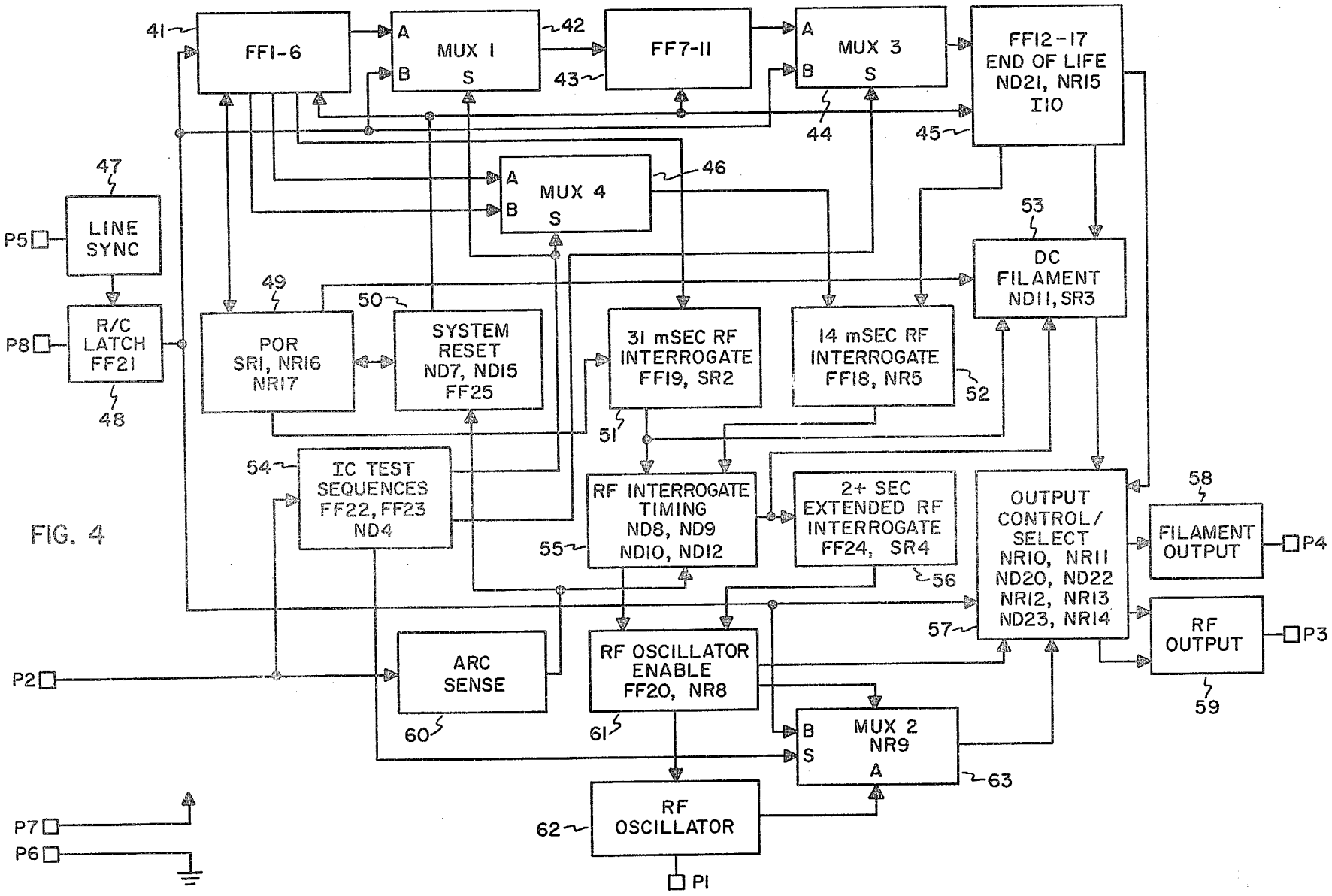
FIG. 4 is a block diagram of the integrated circuit which controls the power supply unit.

The control IC 13 suitable for performing the functions outlined above is described in block diagram form in FIG. 4, and in logic design (suitable for fabrication by a CMOS process) in FIGS. 5A–5F.

The control integrated circuit, which is in the form of an 8 pin device, receives its dc energization (Vdd) at pad P7 from a 7.5 volt Zener diode regulated supply comprising the elements R4, C4 and Z1. The voltage of the Zener diode sets the voltage supplied to the IC (Vdd). The values of resistance R4 (27K ohms) and the capacitor C4 (0.022 microfarad) are chosen in part to cause a desired rate of rise of Vdd for operation of the Power On Reset (POR) circuit in the IC. In particular, the POR circuit provides controlled initialization of the logic in the IC when the lighting unit is first turned on or in the event of a momentary power interruption. The POR circuit senses a voltage intermediate to the Vdd voltage in a conductive, nonreactive path connected between the Vdd bus and the IC ground, and generates a preset pulse. The preset pulse starts at the instant when the IC memories become valid and continues until proper initialization is assured. With the R4, C4 values selected, the preset pulse continues for at least 50 microseconds, corresponding to the time required for Vdd to climb to a first (higher) threshold, typically 4.75 volts, at which time the preset pulse terminates allowing counting to start. The POR circuit contains hysteresis to prevent re-initialization during momentary interruptions in power, being set to trip at typically 3.5 volts. The thresholds are selected to insure that adequate voltage is being supplied to the IC. When Vdd is below the upper threshold, but above the point at which the logic assumes definite states (> 1.5 V), the logic is preset to the desired initial condition and is held in the preset condition until the higher threshold is exceeded. The POR circuit does not require a pad separate from the Vdd input at pad P7.

The POR circuit is the subject of the separate application of Messrs. Peil, Brown and Dissosway entitled "Integrated Power on Reset (POR) Circuit for Use in an Electrical Control System", Ser. No. 433,883, filed Oct. 13, 1982 and assigned to the Assignee of the present application.

The integrated circuit 13 performs the timing and control functions required by the lighting unit as illustrated in the table of FIG. 2 and in the state sequence diagram of FIG. 3.

The principal timing of the integrated circuit is derived from the ac line and is counted down in a counting chain provided on the IC. The IC is also provided with input amplifiers to convert low level analog signals (line and arc sense) to levels compatible with digital logic. In particular, one input amplifier derives a line synchronizing signal used to clock the counter and another input amplifier senses arc lamp current to determine the present state of the arc. In addition, a Power On Reset (POR) circuit is provided to insure that the lighting unit enters the control sequence in the correct initial state when first turned on or in the event of power interruptions. Finally, means are provided for expeditiously testing the principal operating circuits of the IC.

As seen in the simplified block diagram of FIG. 4, the integrated circuit may be subdivided into functional blocks 41–63. The details of the logic design of the blocks is provided in FIGS. 5A–5F. The counting chain is a 17 stage counter further subdivided into the block 41 constituting the flip-flops FF1–6; the block 43 constituting the flip-flops FF7–11 and the block 45 constituting the flip-flops FF12–17 (and the associated logic ND21, NR15 and I10). The line current synchronizing signal and a short duration timing pulse (2–3 milliseconds) are derived from the line synchronizing amplifier 47 and the RC latch FF21 (bearing a reference numeral 48). An arc sensing amplifier 60 is provided to sense the state of the arc lamp. The control logic for the filament in the 80 watt dc state is represented by the block 53 and includes ND11 and SR3. The control logic for the RF Interrogate and Extended RF Interrogate is provided by the blocks 51, 52, 55, 56, 61 and 62. The block 51 provides the 31 millisecond RF Interrogate and includes FF19 and SR2. The block 52 provides the 14 millisecond Interrogate and includes FF18 and NR5. The block 55 entitled "RF Interrogate Timing" includes the ND8, ND9, ND10 and ND12 and is responsive to blocks 51 and 52. The block 56 controls the 2+ second Extended RF Interrogate and includes FF24 and SR4. The oscillator enable block 61 includes FF20 and NR8 and is responsive to blocks 55 and 56 to control the block 62 entitled "RF Oscillator". The output control select block 57 couples the "DC" and Duty Cycled" outputs to the filament output driver 58 and the "RF Interrogate" outputs to the RF output driver 59. The output control select block includes NR10, NR11, ND20, ND22, NR12, NR13, ND23 and NR14. The Power On Reset function is divided into the blocks 49 and 50. Block 49 consists of the Power on Reset Circuit per se and the components SR1, NR16 and NR17. The System Reset block 50 includes ND7, ND15 and FF25. IC testing is provided by the block 54 entitled "IC Test Sequences" including FF22, FF23 and ND4 and the MUX 1–4 blocks bearing the reference numerals 42, 63, 44 and 46, respectively. Block 63 additionally includes the element NR9.

The timing function for the states of the lighting unit is provided by the blocks 47, 48, which derive a line synchronizing signal or clock pulse $\phi$ having a selected 2 millisecond on time and $8\frac{1}{3}$ millisecond period, and by the counter chain consisting of the blocks 41, 43 and 45, which count the clock pulses to derive timing periods of various durations. The operation of these blocks will now be described with reference to FIGS. 4, 5A–5C and 6A and 6B.

Figure 5A:
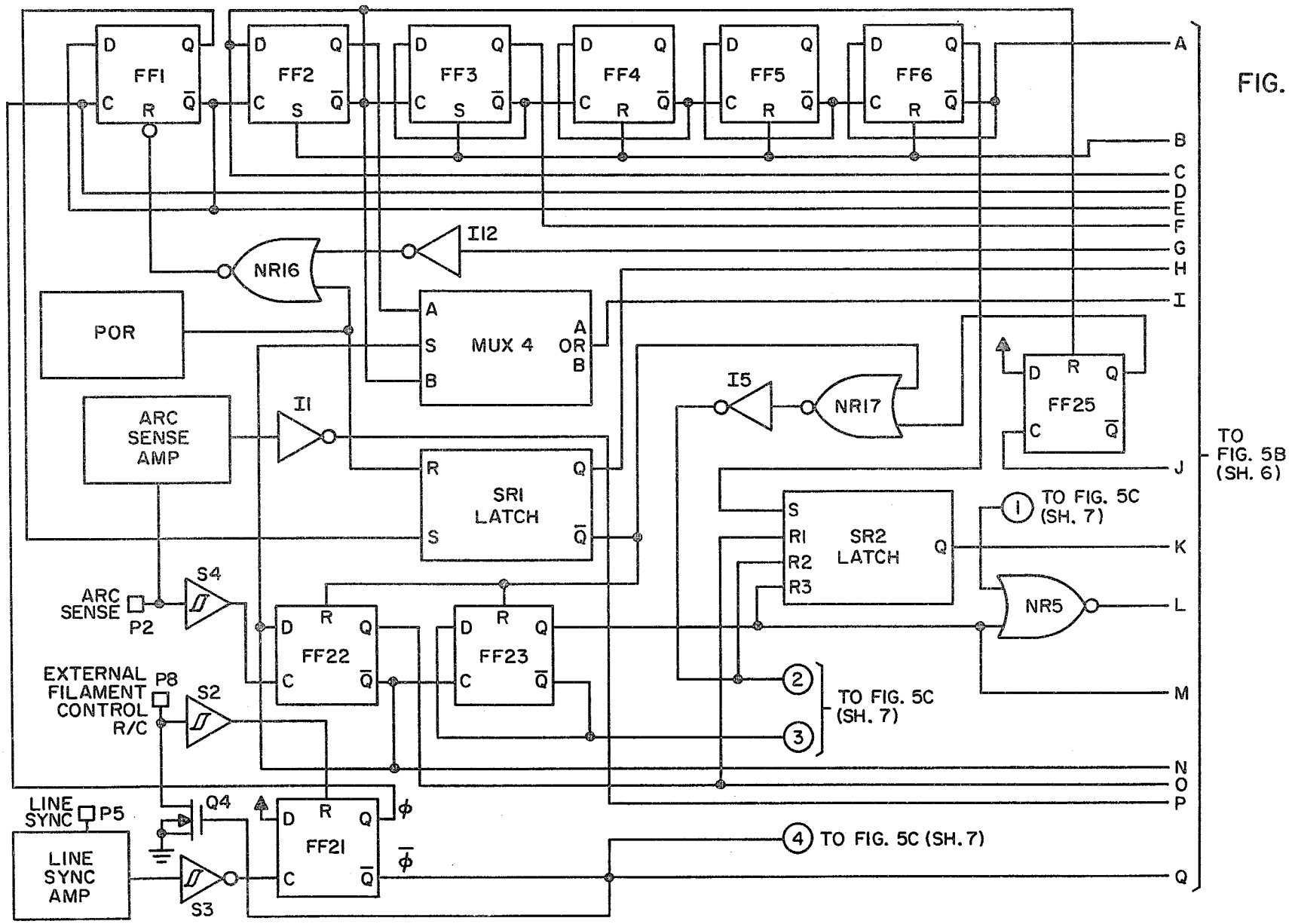
FIGS. 5A, 5B, 5C, 5D, 5E and 5F are logic diagrams of the control integrated circuit. More particularly, FIGS. 5A, 5B and 5C combine to illustrate the logical design of the integrated circuit.
Figure 6A:
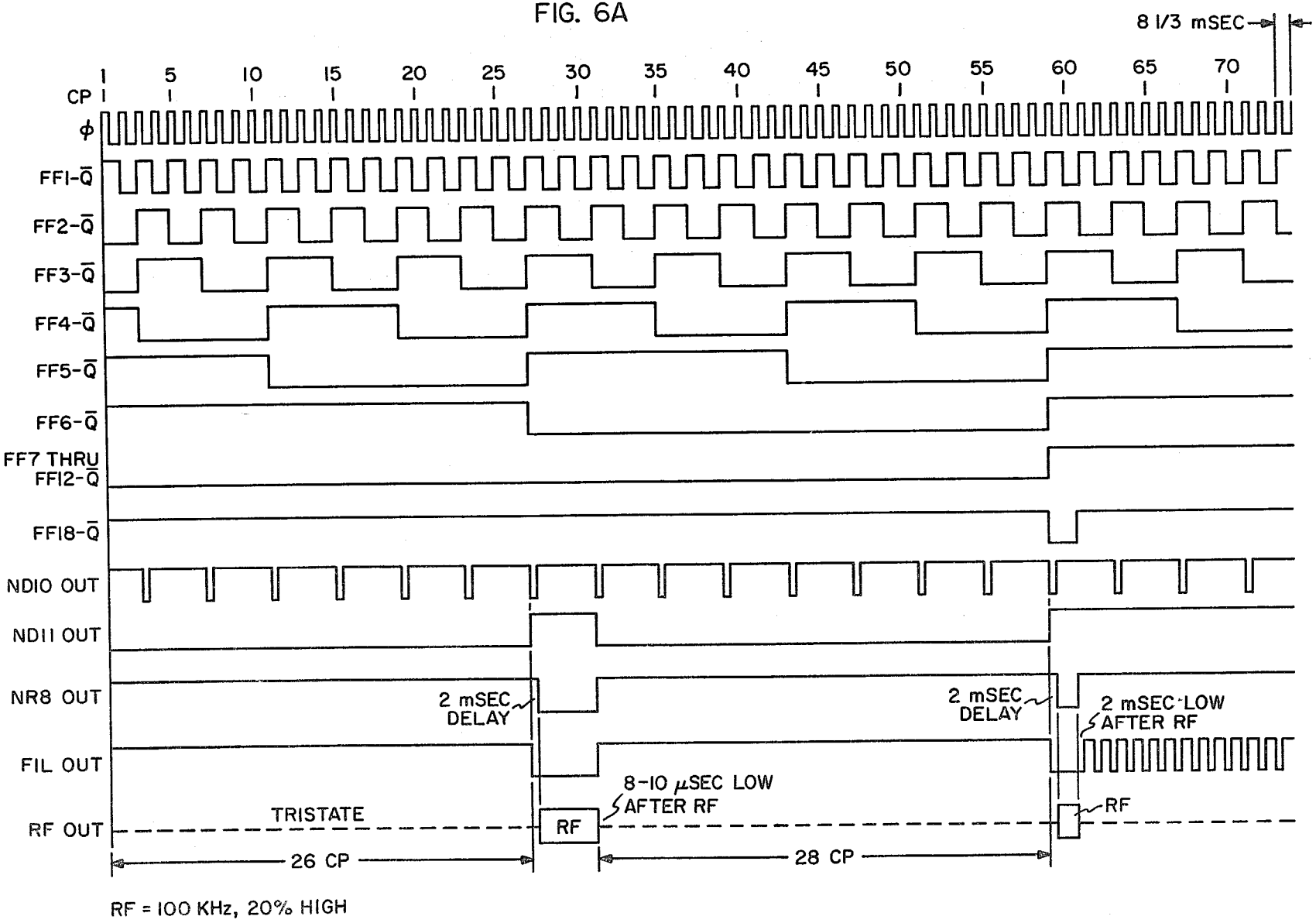
FIG. 6A is a collection of waveforms relevant to operation of the control integrated circuit and represents the portion of a starting sequence which entails two applications of high frequency energy to start the arc lamp, unaccompanied by a breakdown.
Figure 6B:
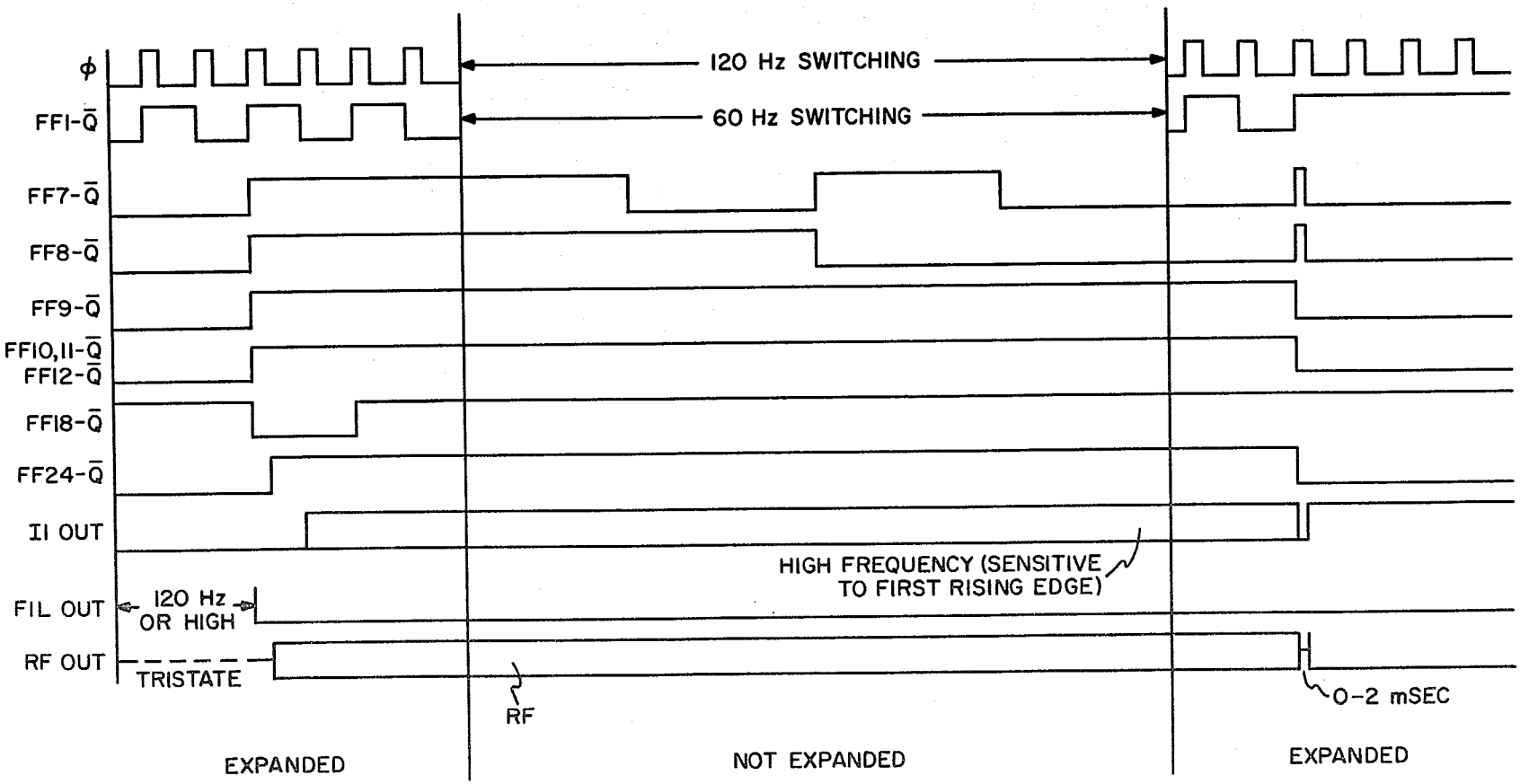
FIG. 6B is an illustration of breakdown with the arc transitioning.

The clock pulse $\phi$, supplied by the blocks 47 and 48 of FIG. 4, is illustrated as the first waveform in FIGS. 6A and 6B. It is derived by the following circuit elements in FIGS. 1 and 5A. The block 47 of FIG. 4 consists of the line synchronizing amplifier (Line Sync), whose input is connected to pad P5 and whose output is connected to the input of the inverting hysteresis gate S3, all as shown in FIG. 5A. The pad P5 is connected to the interconnection between R6 and C1 in the dc power supply as shown in FIG. 1. The block 48 (FIG. 4) (flip-flop FF21, FET Q4 and hysteresis gate S2) provides a connection to the pad P8 as shown in FIG. 5A. The clocking input (C) of FF21 is connected to the output of the hysteresis gate S3 and the $\overline{Q}$ output of FF21 is connected to the gate of the n-channel FET Q4. The substrate and source of Q4 are connected to the internal IC ground and the drain is coupled to pad P8 to which external timing components R5 and C6 are connected. The input of the hysteresis gate S2 is also connected to pad P8 and the output of S2 is connected to the reset input (R) of FF21. The D terminal of FF21 is connected to Vdd and the Q output of FF21 (clock pulse $\phi$) is connected to the clocking input of FF1.

The clocking pulse $\phi$ is derived in the following manner. Timing information is provided by the line sync amplifier whose input signal is the voltage across R6 used to sense current pulses in the capacitor C1. The amplifier output is a high or low logic level dependent on whether the voltage drop produced by the current in resistance R6 is above or below the amplifier threshold. A suitable amplifier is described in the separate application of Messrs. Peil, Brown and Dissosway entitled "A Threshold Amplifier for IC Fabrication, Ser. No. 393,696, filed June 30, 1982 and assigned to the Assignee of the present application. The amplifier output, which is coupled to the hysteresis gate S3, then produces a pulse (S3 OUT) which has a period of $8\frac{1}{3}$ milliseconds and a variable duration which is a function of the duration of the charging interval of the capacitor C1 in the DC supply.

The timing of the $\phi$ waveform occurs in the following manner. The S3 output pulse when coupled to the clocking input (C) of FF21 causes $\overline{Q}$ to go low making Q4 nonconductive and allowing the voltage at pad P8 (the R5, C6 timing circuit), which is energized by its connection to the 7.5 volt Zener supply, to begin to rise. When the voltage on pad P8 exceeds the upper threshold of hysteresis gate S2, its output resets FF21 inverting the output states of FF21 and with $\overline{Q}$ high, Q4 becomes conductive, discharging the R5, C6 network. The waveform $\phi$ (at the Q output of FF21) is coupled to the clocking (C) input of the first flip-flop FF1 in the counter. The other output of FF21, $\overline{Q}$, is coupled to the B input of multiplexer block 63 (MUX2) and to the Output Control/Select block 57. The selection of R5, C6 sets the duty cycle of $\phi$ at about 75% giving a filament dissipation of 56 watts in the duty cycle mode.

Figure 5B:
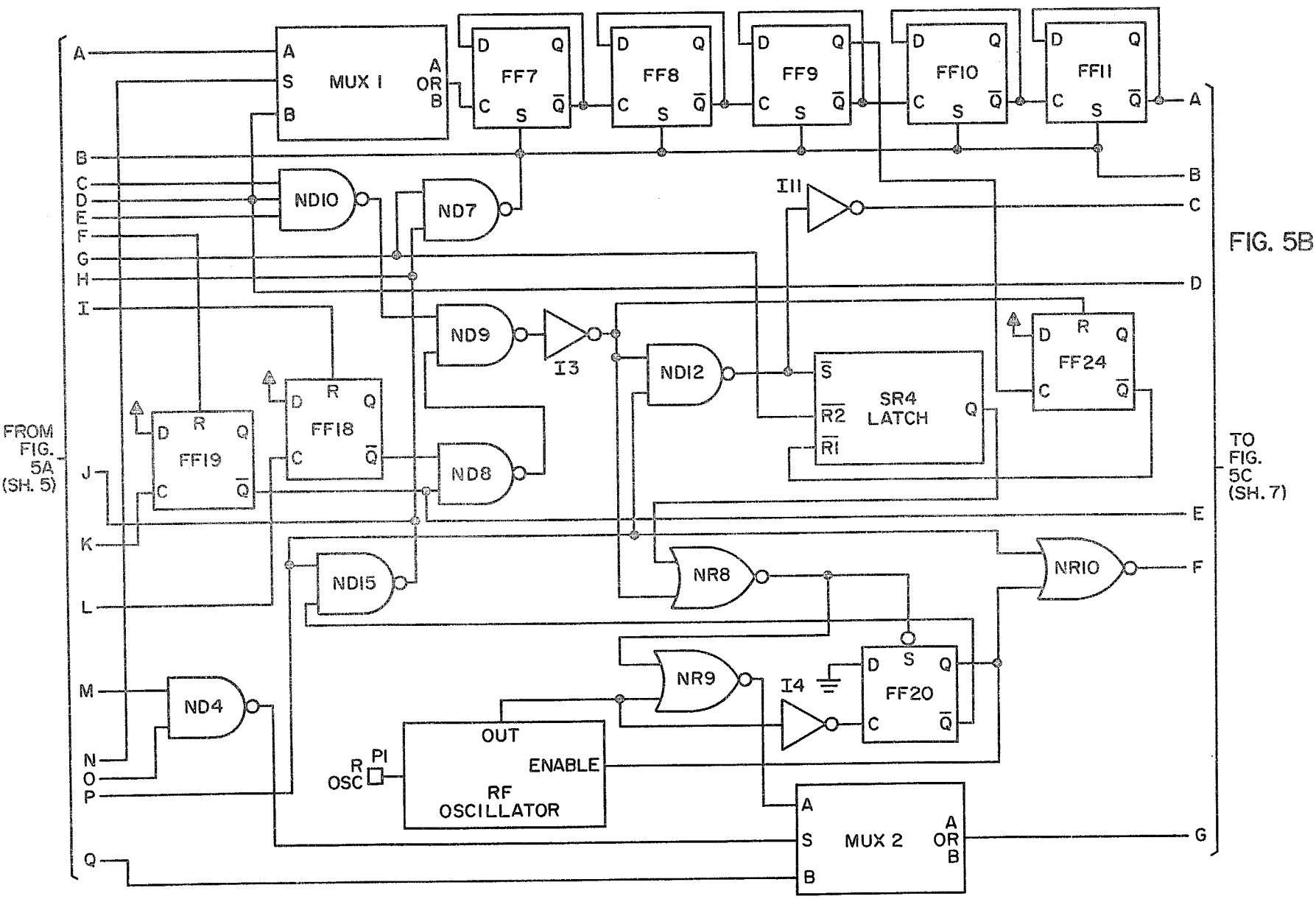
Figure 5C:
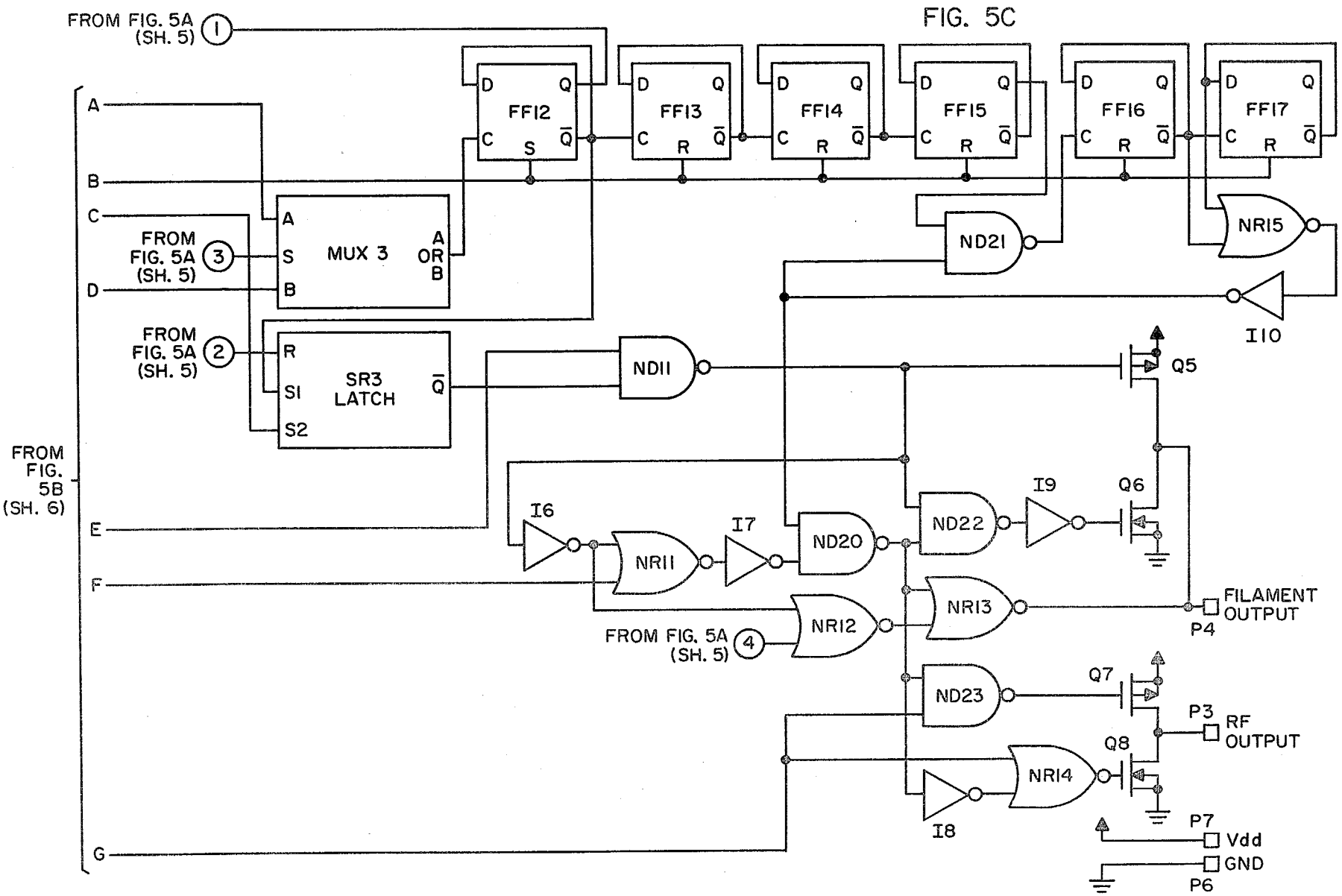
Figure 5D:
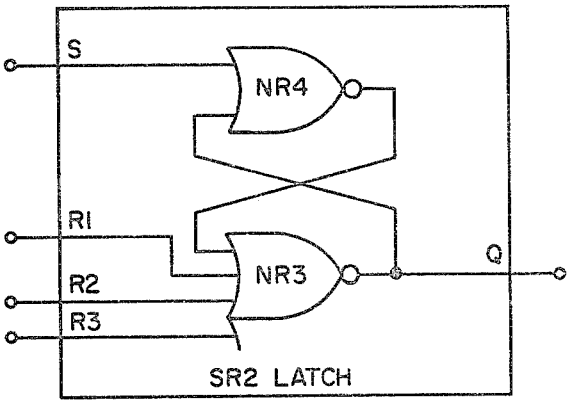
Figure 5E:
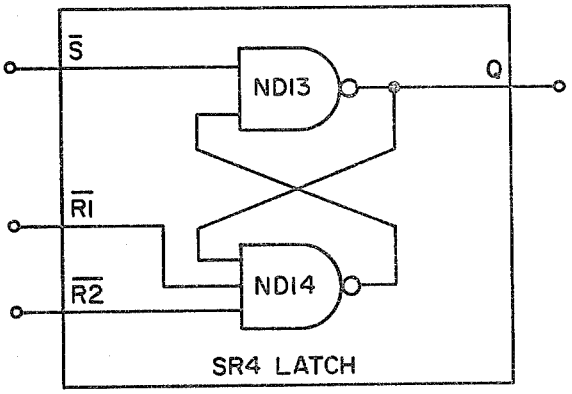
Figure 5F:
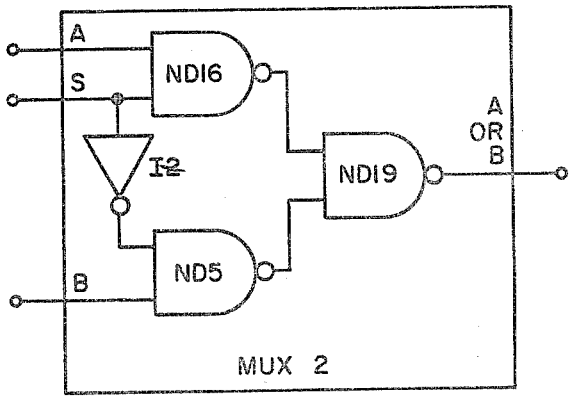

The 17 stage counter chain, which consists of the counter blocks 41, 43 and 45 interspersed with multiplexer blocks 42 and 44, as shown in FIG. 4, is connected as shown in FIGS. 5A, 5B and 5C. The block 41, detailed in FIG. 5A, consists of the flip-flops FF1-6, each having an indicated C, D, Q, $\overline{Q}$ and R or S connection. FF1 has its clocking (C) input connected (as already noted) to the Q output of FF21 and its Q output to the S (set) input of the SR1 latch (for reasons that will be developed). The $\overline{Q}$ output of each stage (FF1, FF2, FF3, FF4, FF5, FF6) is coupled back to the data (D) input of the same stage and to the clocking (C) input of the succeeding stage or component. The $\overline{Q}$ outputs of the stages FF1–FF6 are shown in the six waveforms illustrated in FIG. 6A immediately below the $\phi$ waveform. The Reset (R) connection of FF1 is connected to the output of NR16. The Set (S) connections of FF2, FF3 and the reset (R) connections of FF4, FF5, FF6 are connected to a system preset bus connected to the output of ND7 (see FIG. 5B).

The $\overline{Q}$ output of FF6, which is the last flip-flop in counter block 41, as shown in FIG. 4, is connected to the A input of MUX 1 (block 42) for transfer to counter block 43 (FF7–11). Each multiplexer block (42 and 44) consists of a two input (A, B) multiplexer from which the A or B input may be directed to the output by the select (S) control. The selected A or B output of MUX 1 is connected to the C input of FF7, the first of the 5 flip-flops consistuting block 43. Each of FF7–11 has C, D, Q, $\overline{Q}$ and S connections. As before, the $\overline{Q}$ output of each stage of counter block 43 is connected back to the D input of the same stage and forward to the C input of the succeeding stage or component. The Q output of FF9 is connected to the C input of FF24. All Set (S) connections of FF7–11 are connected to the system preset bus connected to the output of ND7.

The $\overline{Q}$ output of FF11, the last stage of counter block 43, detailed in FIGS. 5B and 5C, is connected to the A input of MUX 3 (block 44), the output of which is connected to the C input of the FF12, the first flip-flop in the counter block 45. The counter block 45 consists of the flip-flops FF12–FF17, ND21, NR15 and I10. The output of block 44 is connected to the C input of FF12. The $\overline{Q}$ output of FF12 is connected back to the D input of FF12, to the C input of FF13, and to the S1 input of SR3 latch. The Q output of FF12 is connected to an input of NR5. Similarly, the $\overline{Q}$ output of FF13 is connected back to the D input of FF13 and forward to the C input of FF14. The $\overline{Q}$ output of FF14 is connected back to the D input of FF14, and forward to the C input of FF15. The $\overline{Q}$ output of FF15 is connected back to the D input of FF15. The Q output from FF15 is coupled to one input of NAND gate ND21. The output of NAND gate ND21 is connected to the C input of FF16, thus continuing the chain. The $\overline{Q}$ output of FF16 is connected back to the D input of FF16 and forward to the C input of FF17. The $\overline{Q}$ output of FF17 is connected back to the D input of FF17. The NOR gate NR15 has its two inputs connected to the $\overline{Q}$ outputs of FF16 and FF17 and has its output connected via the inverter I10 to the second input of NAND gate ND21, ending the counter chain. The Q outputs of FF13, FF14, FF16 and FF17 are unused. The S connection of FF12 and the R connections of FF13–FF17 are connected to the system preset bus connected to the output of ND7.

The counter chain consisting of blocks 41–45 operates in general like a conventional 17 stage counter when the multiplexer blocks 42 and 44 are in the normal (non-test) condition. In other words, the multiplexers connect FF6 to FF7 and FF11 to FF12 creating a continuous counter chain from FF1–FF17. During the testing sequence, as will be explained, the 17 stage sequence is broken to reduce the time required for test. The outputs of selected flip-flops are illustrated in FIGS. 6A and 6B. The $\overline{Q}$ outputs are indicated for flip-flops FF1 through FF12 and FF18.

The states of the lighting unit depicted in FIG. 3 may extend over the timing ranges associated with the counter. The periods of the outputs of FF1–FF17 are disparate as milliseconds, seconds and minutes. Assuming a clock pulse having an $8\frac{1}{3}$ millisecond period at block 48 and continuity in the 17 stage counter, with MUX 1 and MUX 3 (blocks 42 and 44) in the normal (non-test) condition, the state FF6 at the output of block 41, is associated with an approximate period of $\frac{1}{2}$ second, the stage FF11 associated with the output of block 43 with an approximate period of ¼ minute, and the stage FF17 at the output of block 45 with an approximate period of 18 minutes.

The actual time intervals detailed in FIG. 3 are of the magnitudes noted above, and are made up of logical combinations of timing information derived from the $\phi$ waveform (8⅓ millisecond period, 2 millisecond high).

As set out in the table of FIG. 2 and state sequence diagram of FIG. 3, the initial operating state of the lighting unit is Preignition (initially with dc filament energization), followed by an RF Interrogate and (possibly) an Extended RF Interrogate. It has been determined that the breakdown voltage of a cold arc tube can be lowered by exposure to heat and light from an 80 watt filament. The logic has been designed to allow for two approximately ¼ second dc filament periods each preceeding a brief (<31 msec) RF Interrogate state. This gives a very high probability of breakdown (not including transition) within ½ second of turn on. If current is sensed during either RF burst, transitioning the arc takes 2+ seconds, and the warmup (arc on) state is entered into about 3 seconds after turn on. The sets and reset of the first twelve stages of the counter have been chosen to achieve these ends. The last five stages were selected in order to provide approximately thirteen minutes to attempt to break down the arc tube during a hot restart.

The logic which controls the DC and Duty Cycled Filament and the Interrogate timing is shown in FIGS. 5A–5F and the applicable waveforms for the first 75 clock pulses of a non-breakdown start are shown in FIG. 6A.

The dc filament function controlled by the IC involves the dc filament block 53, which includes ND11 and SR3. It is interconnected with blocks 45, 49, 51, 55 and block 57, which controls the filament driver 58. The DC Filament state continues for 26 clock pulses as shown in the Fil Out waveform of FIG. 6A, is interrupted by an RF burst for 4 clock pulses (RF Out waveform of FIG. 6A), and then continues for 28 clock pulses in the event that lamp current is not sensed. The filament output block 58, detailed in FIG. 5C, includes the p-channel FET Q5, whose principal electrodes are connected between Vdd and the filament output pad P4 and the n-channel FET Q6, whose principal electrodes are connected between the pad P4 and ground of the IC. The gate of Q5 is driven by the output of ND11 and the gate of Q6 by the output of I9. Thus, the output of the DC Filament control logic appears at pad P4 for application to the base of transistor Q3 (off the chip).

The RF interrogate function controlled by the IC involves the 31 millisecond RF interrogate block 51, which includes FF19 and SR2, and the 14 millisecond RF interrogate block 52, which includes FF18 and NR5. Also involved are the blocks 55, 57, 61, 62 and 63.

The output of the RF interrogate function on the IC, controlled by the enumerated blocks, is a high frequency (100 KHz) drive coupled via the RF output driver 59 on the chip (via pad P3) to the base of transistor Q2 (off the chip). As shown in FIG. 5C, the RF output driver (block 59 of FIG. 4) consists of a p-channel FET Q7 having its principal electrodes coupled between Vdd and RF output pad P3 and the n-channel FET Q8 having its principal electrodes coupled between the RF output pad P3 and the IC ground. The output of NAND gate ND23 in block 57 is coupled to to the gate of Q7 and the output of NOR gate NR14 is coupled to the gate of Q8. The RF output driver Q7, Q8 exhibits three states. In one state, a high output is produced when the gates of Q7 and Q8 are low. In a second state, a low output is produced when the gates of Q7 and Q8 are both high. In a third state, designated the tristate mode, the gate of Q7 is high and the gate of Q8 is low, providing a high impedance from output pad P3 to both Vdd and ground. In the filament modes, this permits the base of external transistor Q2 to be driven by the emitter of external transistor Q3 without loading from the IC.

The first DC filament mode (block 31, FIG. 3) involves the following logic sequence. After turn on, the POR block of FIG. 5A resets FF1 (Q low) via NR16 and also resets SR1 (Q low). SR1 is held reset until FF1 Q output transitions from low to high, setting SR1 (Q high). While SR1 is reset, its Q output presets the balance of the main counter (16 stages) via ND7 and resets SR4. At the same time, SR1 $\overline{Q}$ resets FF22 and FF23 (test sequence flip flops) and SR2 and SR3 (via NR17 and I5). With FF22–FF23 both reset, MUX 1 directs the $\overline{Q}$ of FF6 to the C input of FF7, MUX 3 (block 44) directs the $\overline{Q}$ output of FF11 to the C input of FF12, MUX 4 (block 46) directs the Q output of FF2 to the reset terminal of FF18, and MUX 2 (block 63) directs the RF oscillator output to ND 23 and NR14. Since FF2 and FF3 are set (Q high) and the Q output of FF3 is coupled to the reset terminal (R) of FF19, both FF18 and FF19 are reset (Q's low) during turn on. Due to the states of Latch SR3 and FF19 ($\overline{Q}$'s high), the ND11 output goes low turning on the upper p-channel FET Q5 in the filament output block 58. A DC signal is thus produced at pad P4 to drive the base of Q3 and thereby turn on the triple transistor switch.

After the first DC filament mode (31), the first RF Interrogate mode (32) follows, and if the arc has not broken down, a second filament mode (35) is produced. These are illustrated in the waveforms of FIG. 6A (ND11 and Fil Out). In the DC Filament mode, the ND11 output remains low and the filament output remains high. At the end of the first DC Filament mode, the $\overline{Q}$ output of FF6 goes low (the 27th clock pulse of FIG. 6A), Latch SR2 is set, driving the C input of FF19 high. This causes the $\overline{Q}$ output of FF19 to go low until the Q output of FF3 goes high, resetting FF19. During this time (clock pulses 27–30), an RF burst is generated at pad P3. Assuming that the arc did not break down, the I1 output is low, forcing $\overline{S}$ of SR4 (via ND12) to remain high and its Q output to remain low. Thus the NR8 output goes high at clock pulse 31, allowing FF20 to be clocked by the oscillator into a reset state, terminating the RF burst. Since the $\overline{Q}$ output of FF19 is high and the $\overline{Q}$ output of SR3 is still high, ND11 turns on the DC Filament output driver Q5, providing an additional 28 clock pulses of DC filament energization. This second DC filament period ends when $\overline{Q}$ of FF12, coupled to the S1 input of SR3, sets SR3 ($\overline{Q}$ low), making ND11 go high, to turn off the output driver Q5 and thereby the external Darlington switch.

The short duration RF Interrogate mode (32, 36), which occurs when the filament output is held low, is also shown in the FIG. 6A waveforms. The first RF interrogate mode (32) occurs as follows. The NAND gate ND10 has three inputs. One is coupled to the Q output of FF21, which supplies the clock pulse $\phi$; another to the $\overline{Q}$ output of FF1; and a third to the $\overline{Q}$ output of FF2. When all three inputs are high, the ND10 output goes low, lasting for the 2 millisecond duration of $\phi$ as shown, and then ND10 goes high. Since the $\overline{Q}$ output of FF18 is high and the $\overline{Q}$ output of FF19 is high, the output of ND8 is low. When $\overline{Q}$ of FF6 goes low at clock pulse 27, FF19 is clocked (a low to high transition at its C input) driving $\overline{Q}$ low. With the $\overline{Q}$ of FF19 low and the $\overline{Q}$ of FF18 high, a high is produced at the output of NAND gate ND8. When ND10 goes high, 2 milliseconds after clock pulse 27, the high from ND8 produces a low at the ND9 output, and a high at the I3 output, which among other things, resets FF24 ($\overline{Q}$ high) and resets SR4 latch (Q low). The high at the I3 output, coupled to one input of the NOR gate NR8, with a low from SR4, produces a low at the $\overline{S}$ input of FF20, causing Q to go high, which causes the RF oscillator (block 62) to be enabled (turned on). The oscillator output is coupled via NR9 (now pulsing at the RF oscillator rate) to the A input of MUX 2 (block 63) to an input of the NAND gate ND23 and NOR gate NR14. On the first RF interrogate (state 32), the oscillator output pulse terminates when FF19 is reset ($\overline{Q}$ high) by Q of FF3 going high. This forces the $\overline{S}$ of FF20 to go high (via ND8, ND9, I3, and NR8) and 8 to 10 microseconds later the oscillator clocks FF20, causing Q of FF20 to go low terminating the interrogate and turning the DC filament back on.

The second RF Interrogate state (36) occurs in the following manner. After the second DC filament state (35), FF18 is clocked by Q of FF12 via NR5 since Q of FF23 is low (the non-test state) causing FF18 $\overline{Q}$ to be low. With $\overline{Q}$ of FF18 low and $\overline{Q}$ of FF19 high, a high is produced at the output of NAND gate ND8. When ND10 goes high 2 milliseconds after clock pulse 59, the high from ND8 produces a low at the ND9 output, and a high at the I3 output, causing the same effect as previously discussed, including enabling the oscillator. Once FF2 is clocked (Q goes high), FF18 is reset ($\overline{Q}$ high). This again forces $\overline{S}$ of FF20 to go high (via ND8, ND9, I3 and NR8) and 8 to 10 microseconds later the oscillator clocks FF20, causing Q of FF20 to go low terminating the interrogate at the end of clock pulse 60.

After the second RF Interrogate state (36) the filament is energized for a longer period ($\sim\frac{1}{2}$ minute) at lower power (56 watts) in a duty cycled mode. At the start of the second interrogate, FF12 $\overline{Q}$ also sets SR3 ($\overline{Q}$ low), thus terminating the dc filament mode (the ND11 output will remain high, keeping Q5 off). With no arc current sensed (I1 output low) and the Q output of FF20 low, NR10 produces a high, causing the NR11 output to be low and the I7 output to be high. Since the I10 output is high (assuming End of Life State has not yet occurred), the output of ND20 will be low, the output of ND22 will be high and the output of I9 will be low, keeping Q6 off. The ND20 output, being low, also produces a low input into NR13 so that the inversion of NR12 will appear at the filament output pad P4. Since the ND11 output is high, the I6 output (and thus one input of NR12) is low. The other input of NR12, $\overline{\phi}$, is thus coupled to the filament output pad P4, via NR 12 and NR13. Thus, at the end of each interrogate, not including the first one, since $\overline{\phi}$ is low, the Darlington switch is held off for this two millisecond period. Assuming there is no arc at the end of this 2 millisecond period, when $\overline{\phi}$ transitions high, the filament will be turned on by Q1, Q2, Q3. The filament will continue to switch on and off with $\overline{\phi}$ (120 Hz) for the duration of the duty cycled filament mode (block 39 of FIG. 3). Two hundred and fifty-four clock pulses after entering this mode, the Q output of FF9 transitions from low to high. This clocks FF24 once again driving its $\overline{Q}$ low (the set state).

The Duty-Cycled Filament mode (39) continues for 4094 clock pulses (34.1 seconds), after which the 2 clock pulse RF Interrogate mode 36 recurs. The 36-39-36-39-36 sequence will continue until the End of Life state (40) or until breakdown of the arc occurs, followed by an Extended Interrogate (37) and transitioning of the arc to the "Arc On" state (34). Assuming that the arc breaks down during a subsequent 2 clock pulse interrogate (36), the sequence shown in FIG. 6B will occur. The I1 output will start switching when the arc breaks down, with the first rising edge causing the state to change from the Interrogate state (36) to the Extended Interrogate state (37). Since I3 is high during the Interrogate state and I1 pulses high, ND12 causes the $\overline{S}$ input of SR4 to pulse low. Since the $\overline{Q}$ output of FF24 is high (FF24 had been reset as previously described), and the $\overline{R2}$ input of SR4 is also high (since the POR is over), SR4 will be set (Q will go high). This causes the output of NR8 to remain low and FF20 will remain set as long as SR4 is set. When the Q output of FF9 transitions from low to high, FF24 is clocked and the $\overline{Q}$ output will go low. This causes $\overline{R1}$ to go low, resetting SR4 (Q low). Since the pulse from I3 transitioned low two clock pulses after the interrogates began, and the Q output of SR4 is low, the $\overline{S}$ input of FF20 goes high. When the oscillator pulse at the output of I4 goes high, FF20 will be clocked low. This generates an 8 to 10 microsecond period of off time followed by a two millisecond off time as described under the termination of the second interrogate.

At the end of the two millisecond period, the IC will have entered either the Arc On state (34) or the Duty Cycled Filament state (38). If the arc remains on, I1 will be high, as shown in FIG. 6B, and the NR10 output will be held low. Since I6 is low, the NR11 output will be high. This forces the I7 output to be low and the ND20 output to be high. Since the ND11 output is high, the ND22 output will be low, and the I9 output will be high turning Q6 on, pulling the filament output pad P4 low. ND20 also forces the NR13 output to go low, aiding in pulling P4 low. The state of ND20 also enables ND23 and NR14. Since the oscillator is off, and the output of NR8 is high, the output of NR9 is low, causing the output of MUX 2 to be low. Thus, the RF output pad P3 is also held low while the arc is on. Furthermore, the $\overline{Q}$ output of FF20 is coupled with the output of I1 (both high at this time) to cause the counter to be held preset via ND15 and ND7. The system will remain in the Arc On state (34) until the arc falls out.

Once the Arc On state (34) is attained, the control logic causes a return to state 31 upon arc failure. ND15 will transition from low to high causing a pulse to be generated at the C input of FF25. Since FF2 was set ($\overline{Q}$ low), the pulse at the C input causes the Q output of FF25 to go high. This generates a reset pulse via NR17 and I5, which resets SR2 and SR3, putting the system back into the POR DC Filament state (31) reinitiating the starting sequence.

If at the end of extended interrogate (37) the arc had not transitioned (the output of I1 low), the system would enter a Duty Cycled Filament mode (38). This mode would last for a period of 3838 clock pulses (32 seconds). The only difference between blocks 38 and 39 is the 2.1 second difference in duration. Block 38 is shortened by the length of the Extended Interrogate.

Thus, after the 3838 clock pulses, a two clock pulse interrogate is generated.

If it is assumed that the arc broke down during the first RF Interrogate mode (32) (a four clock pulse interrogate), the Extended RF Interrogage mode (33) is next. The logic causing the entrance into or exit from 33 is the same as that for 37, but the time duration of 33 is slightly longer since a transition on FF6 rather than FF12 initiated the sequence. At the end of this Extended RF Interrogate mode (37), the next state is either the Arc On state (34) or the Duty Cycled Filament mode (38).

If it is assumed that the arc lamp has failed to start, it is desirable to terminate the RF interrogation after a fixed amount of time. FF13–FF17 with gates ND21, NR15 and I10 perform this function. Each recurrence of 36 (i.e. each low to high transition of the $\overline{Q}$ output of FF12) clocks this five stage End of Life Counter. When both FF16 $\overline{Q}$ and FF17 $\overline{Q}$ are low, NR15 will go high and I10 low. When this occurs, inverter I10 causes ND 21 to lock the counter. The inverter I10 also forces ND20 to turn on both Outputs at pads P3 and P4 to sink current at the bases of Q3 and Q2 (i.e. keeps Q1, Q2, Q3 off). This results in the filament being kept off and terminates the clock pulses, since there is no longer any significant discharge or charge of capacitor C1 for the IC to sense. This is the End of Life state (40).

If the arc never starts, the time to reach this state is 94,266 clock pulses (13.09 minutes). Once in the End of Life State, the only way to exit is by the generation of a Power on Reset signal. This is normally accomplished by turning the power (ac main) off and allowing C1 to discharge.

Also included in the control IC is logic to generate test sequences. Due to the duration of time intervals on the IC (e.g. 13 minutes to End of Life shutdown), the logic necessary for shortening test times is incorporated in order to make high volume production practical. The logic shown in FIGS. 5A–5F allows for full testing within practical time limits for both IC testing and assembled ballast testing. In order to accomplish this, the test logic speeds up the following: time between RF Interrogates (blocks 38 and 39 of FIG. 3), duration of the RF Interrogate (block 36) and the Extended RF Interrogate (block 40). Also included is logic for testing the RF Output drives.

Access to the test functions is achieved via pad P2 on the IC. As seen in FIG. 5A, pad P2 is a dual function pad. This pad is normally used for sensing arc current, but is also used for access to the test sequence generator. Since the voltage of R1 (FIG. 1) does not exceed 1 volt under normal conditions, a threshold for S4 (the hysteresis gate on pad P2 used to access test flip flop FF22) is designed which is greater than 1 volt. The typical value for this threshold is 5 volts. Thus a 5 volt signal should be applied for a time long enough for both S4 and the arc sense amplifier to respond (typically 50 microseconds).

Upon application of the first 5 volt pulse (not during the time SR1 is reset or during an interrogate), the first test state is enabled. As a result of the pulse out of S4, the Q output of FF22 is clocked high. This drives the select lines of multiplexers 1 and 4 high. Thus MUX 1 directs $\phi$ (instead of FF6 $\overline{Q}$) to the clock of FF7 and MUX 4 directs FF2 $\overline{Q}$ (instead of FF2 Q) to the reset of FF18. Since the 5 volt pulse lasted long enough for the arc sense amplifier to respond, the counter was preset (via I1, ND15 and ND7). Since Q of FF2 is high, the R1 line of SR2 Latch is held high, which prevents the 31 millisecond RF Interrogate (block 33) from occurring (assuming the test sequence was initiated before the first interrogate). Therefore, with $\phi$ clocking FF7, the first clock pulse after the S4 output goes low, generates an RF Interrogate. However, the duration is now determined by FF2 $\overline{Q}$. Since FF1 was reset and FF2 set, there are two pulses from the time S4 Out goes low until $\overline{Q}$ of FF2 goes high. Since the first pulse started the interrogate, the duration of the burst is reduced from 2 clock pulses to 1 clock pulse (a 6 msec burst). With the clocking of FF7, the time between interrogates is now reduced to 0.533 seconds (64 clock pulses). If arc breakdown is sensed during the shortened RF interrogate, a shortened Extended RF Interrogate is generated. Since FF9 controls the termination of the Extended RF Interrogate (via FF24), the total burst time will be only 31 milliseconds (4 clock pulses). At the end of this time, the system can be forced into the Arc On state (injecting current, e.g. 0.3 amperes, into R1) or it will return to the Duty Cycled Filament mode for 60 clock pulses. This test could be continued until End of Life is reached (1472 clock pulses or 12.3 seconds). However, a separate test is provided for End of Life testing.

Upon application of the second 5 volt pulse, the two stage counter (FF22,FF23) is clocked. This forces Q of FF22 low and Q of FF23 high. Thus, the SR2 latch is still held reset because R3 is high, preventing the 31 millisecond RF Interrogate. In fact, the second test sequence blocks all interrogates by forcing one input to NR5 high. This prevents Q12 from getting to the clock input of FF18. Therefore, since the select input of MUX 3 is high, $\phi$ is now directed to the clock of FF12. Thus, the End of Life counter can be tested in 47 clock pulses (0.4 seconds).

The final test state which is entered by means of another 5 volt pulse on pad P2 is designed to aid testing of the RF drive currents. During this test, both of the FF22 and FF23 Q outputs are high. Thus, the two high inputs into ND4 provide a low at the output which drives the select input of MUX 2 low. Since FF 23 Q output is high, this state is similar to that in the second test sequence. However, when End of Life is reached (after 47 clock pulses), $\overline{\phi}$ is directed to the RF output via MUX2 and ND23, NR14. Thus there is a controlled method of providing source and sink currents on pad P3 (RF output) for external measurement. Alternately, if the pulse on pad P2 is held above 100 mV after being pulsed to 5 volts, the RF output will have $\overline{\phi}$ on it without having to clock the 47 pulses. Thus, the test procedure detailed above allows rapid testing of the lighting unit and requires no additional IC pins.

Figure 7A:
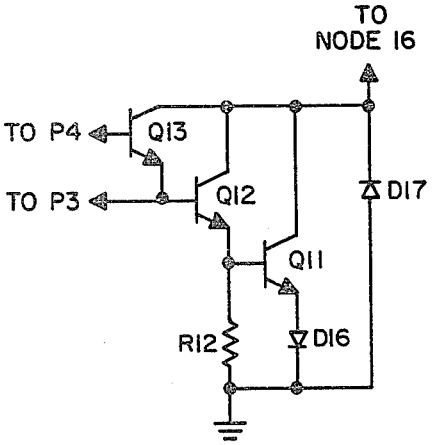
FIGS. 7A and 7B are alternate configurations of the three transistor switch of the operating network of the power supply unit.
Figure 7B:
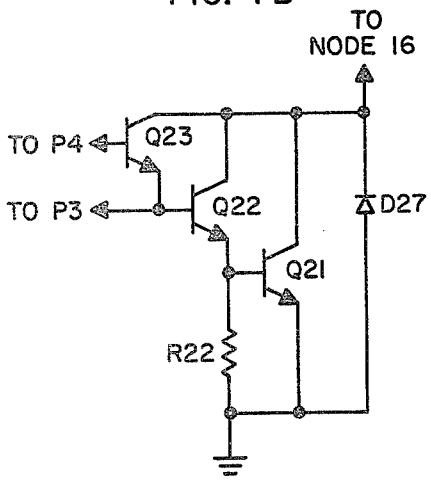

The integrated circuit which has been described provides the output waveforms at pads P3 and P4 for driving the Darlington transistor switch, Q3, Q2, Q1 as shown in FIG. 1. Diodes D5 and D7 are used with the Darlington switch, as previously described, to protect the integrated circuit at its output pads from negative switching transients. The Darlington switch illustrated in FIG. 1 may take two alternate forms which will also provide both the required switching properties and protection of the IC from negative transients. These variations, which are illustrated in FIGS. 7A and 7B, have the same external connections as in the FIG. 1 embodiment. These connections are to the power supply reference terminal, to node 16 in the off-the-chip circuitry, to the filament control input from pad P4 on the IC and to the RF interrogate control input from pad P3 on the IC.

The FIG. 7A variation is designed for fabrication using available discrete components and entails three transistors Q13, Q12 and Q11, all having the same properties as the transistors shown in the FIG. 1 embodiment and having the same Darlington interconnection. Also, as in FIG. 1, a diode D16 is provided in the emitter opath of Q11 and a resistance R12 (12 ohms) as a shunt from the base of Q11 to ground. However, in the FIG. 7A embodiment, the negative transient protection is provided by a high voltage diode D17 connected between ground and node 16 which is common to the collectors of all three transistors Q11, Q12, Q13. The diode D17 is poled to prevent the node from going negative in excess of a diode drop with respect to ground. The shunt diodes D17 in the FIG. 7A arrangement replaces the diodes D5 and D7 in the FIG. 1 arrangement for protection of the IC from negative transients.

The FIG. 7B variation is designed for a custom Darlington arrangement in which three transistor devices designed for the purpose are fabricated on a common substrate. Transistors Q23, Q22, Q21 are all high voltage devices tailored for the currents and frequencies that they must handle and for the substantial current gains required for the application. Transistor Q21 is tailored for both high current and high frequency operation so as to minimize stored charge. The custom design provides for stored charge removal using internal resistor R22 only. Negative transient protection is provided as in FIG. 7A by a shunt diode D27 connected from node 16 to ground. This diode may be fabricated on a common substrate with the custom Darlington transistors, or may be an external device such as that used in the FIG. 7A embodiment.

The use of a triple transistor switch (either in the embodiment of FIG. 1 or the variations of FIGS. 7A and 7B) where one input connection is used for the dc and 120 Hz Filament drive and another connection for the 100 KHz high frequency RF Interrogate drive has several practical advantages. The additional gain of Q3 permits handling the large cold filament inrush currents at Q1 and at the same time permits use of a rise time reducing capacitor C5 at the base of Q3 to reduce emi in 120 Hz operation. The high frequency input for Q2 is thus isolated from the Q3 input circuit and may readily operate at the 100 KHz frequency required for the RF Interrogate function. The gain of Q2 is adequate for switching Q1 at the current levels required for RF interrogation; the tri-state output condition available at pad P3 represents a high source impedance state during filament drive, allowing the signal from the Q3 emitter to drive the base of Q2 without loading from the IC connection at pad P3.

The present three transistor switching arrangement, combining three Darlington connected transistors and controlled by an integrated circuit, has provided a more economic solution than hitherto for providing the switching requirements for the lighting unit herein described. The same transistor switching configuration has adequate current handling capacity for efficient quick warm-up of a cold filament at an initial high power (80 W) level. It may also be used for efficient duty-cycled operation of the filament at a selected lower power (56 W) over longer periods of the starting cycle. It may also be switched at the high frequency rate (100 kHz) required for efficient ignition and transition of the arc lamp to low voltage operation.

The use of the integrated circuit for control of the transistor switch permits a complex, highly adaptive starting procedure with minimum electromagnetic interference, reasonable costs, and high reliability. The arrangement causes minimum voltage and thermal stresses on the electronic components, maximizing reliability. In the starting procedure, the bursts of ignition energy are short (<31 msec.), and are provided at a rate reasonable in relation to the need. Bursts are provided at quarter-second intervals during starting for a cold arc lamp, and at half minute intervals for a "hot restart", which may last for several minutes. When breakdown occurs, the period of extended ignition for transitioning the arc to low voltage operation is restricted to less than 3 seconds. In the event that the arc lamp will not start, as for instance due to arc lamp failure, the burst duration and spacing is like that for a "hot restart", but terminates with the "End of Life" logic, after a period comparable to a quarter of an hour (13 minutes).

What is claimed is:

1. A lighting unit comprising:

A. a dc power source having two output terminals, the second, a reference terminal, B. a metal vapor arc lamp having an anode and a cathode, and C. an operating network comprising:

(1) an incandescible filamentary resistance to provide standby light for said arc lamp, (2) a transformer for deriving a stepped-up output voltage, having a first and a second winding, (3) a semiconductor switch comprising a three transistor combination, each transistor having a base, emitter and collector electrode, the emitter of the first transistor being connected to the base of the second transistor, the emitter of the second transistor being connected to the base of the third transistor, (4) a capacitor;

said arc lamp and operating network being connected in branches diverging from a common node; said filamentary resistance being connected in a first branch between said first source output terminal and said node; said second winding and said arc lamp being connected in series in a second branch between said node and said second source terminal; said third transistor being connected with its collector and emitter in a third branch between said node and said second source terminal; and said first winding and said capacitor being serially connected in a fourth branch between said node and said second source terminal;

said operating network further comprising:

(5) control means for operating said switch in a multistate starting sequence, said states including:

(a) a preignition state in which said switch is operated at an appropriately low, including zero, switching rate for conducting current through said serially connected first and third branches for incandescent operation of said filamentary resistance, said capacitor precluding dc current flow through said fourth branch;

(b) an ignition state in which said switch is operated cyclically at an appropriately high switching rate for energizing said first, second and fourth branches for incandescent operation of said filamentary resistance, and for ignition and transition of the arc in said arc lamp; and (c) an ignited state in which said switch remains off with the current supplied from said dc source flowing in said serially connected first and second branches to maintain said arc, said filamentary resistance ballasting said arc lamp.

2. A lighting unit as set forth in claim 1 wherein said control means comprises:

(1) a first base drive means coupled to the base of said first transistor for said low switching rate operation, and (2) a second base drive means coupled to the base of said second transistor for said high switching rate operation.

3. A lighting unit as set forth in claim 2 wherein said first base drive means couples a first turn-on signal, dc, of short duration, adequate in length and amplitude to heat a cold filament to incandescence.

4. A lighting unit as set forth in claim 3 wherein said first base drive means couples a second, pulsating turn-on signal at said low switching rate, having a duty cycle selected to maintain said filament at incandescence at a lower power level than said first turn-on signal.

5. A lighting unit as set forth in claim 1 wherein said capacitor has a value selected in respect to the parameters of said transformer and said high switching rate to provide an adequately large transformer output voltage for ignition, and optimum power for transitioning said arc.

6. A lighting unit as set forth in claim 1 wherein each of said windings has a first and a second terminal, the first terminal of each winding being of the same sense, said first winding being oriented in said fourth branch with the first terminal toward said node, and said second winding being oriented in said second branch with the first terminal toward said second source terminal, whereby the voltages in said two windings add to increase the ignition voltage between the anode and cathode of said arc lamp.

7. A lighting unit as set forth in claim 2 wherein means are provided to remove stored charge from said third transistor, said means comprising:

(1) a diode poled for forward conduction inserted in said third branch between the emitter of said third transistor and said second source terminal, and having a stored charge greater than that of said third transistor, and (2) a resistance connected between the base of said third transistor and said second source terminal having a value selected to remove said stored charge for efficient operation at said high switching rate.

8. A lighting unit as set forth in claim 6 wherein said first and second base drive means are incorporated in an integrated circuit;

said three transistors are of the NPN conductivity type, and said first source terminal is of positive polarity in respect to said second source terminal; and wherein means are provided to protect said integrated circuit from the injection of negative polarity voltages via said base drive connections, the collectors of said first and second transistors being connected together, said means including a diode connected between the collector of said third transistor and the collectors of said first and second transistors, poled to prevent the application of negative polarity voltages to the collectors of said first and second transistors.

9. A lighting unit as set forth in claim 8 wherein said protection means further includes a diode having the cathode thereof connected to the emitter of said second transistor and the anode thereof connected to said second source output terminal, to preclude the bases of said first and second transistors from going substantially negative.

10. A lighting unit as set forth in claim 6 wherein said first and second base drive means are incorporated in an integrated circuit;

said three transistors are of the NPN conductivity type, and said first source terminal is of positive polarity in respect to said second source terminal; and wherein means are provided to protect said integrated circuit from the injection of negative polarity voltages via said base drive connections, the collectors of said first, second and third transistors being connected together, said means including a diode having its cathode connected to said collectors and its anode connected to said second source terminal.

11. A lighting unit as set forth in claim 6 wherein said second winding is arranged around said first winding, with the lower voltage turns of said second winding being in closer proximity to said first winding to reduce the capacitive coupling of high voltages present in the secondary winding to said primary winding.

* * * * *